US008042905B2

(12) United States Patent
Saita et al.

(10) Patent No.: US 8,042,905 B2
(45) Date of Patent: Oct. 25, 2011

(54) INKJET RECORDING APPARATUS, TEST IMAGE FORMING METHOD, AND COMPUTER-READABLE MEDIUM

(75) Inventors: Hirofumi Saita, Kanagawa (JP); Toru Shimizu, Ebina (JP)

(73) Assignees: Fujifilm Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 425 days.

(21) Appl. No.: 12/414,139

(22) Filed: Mar. 30, 2009

(65) Prior Publication Data

US 2009/0244167 A1 Oct. 1, 2009

(30) Foreign Application Priority Data

Mar. 31, 2008 (JP) ..... 2008-093089

(51) Int. Cl.
*B41J 29/393* (2006.01)
*B41J 29/38* (2006.01)
*B41J 2/155* (2006.01)

(52) U.S. Cl. ..... 347/19; 347/13; 347/42

(58) Field of Classification Search ..... 347/13, 347/19, 42
See application file for complete search history.

(56) References Cited

U.S. PATENT DOCUMENTS

2007/0013732 A1* 1/2007 Sakamoto et al. ..... 347/20
2007/0040878 A1* 2/2007 Ikefuji et al. ..... 347/90

FOREIGN PATENT DOCUMENTS

JP 2004-9474 A 1/2004

* cited by examiner

*Primary Examiner* — Julian Huffman
(74) *Attorney, Agent, or Firm* — Birch, Stewart, Kolasch & Birch, LLP

(57) ABSTRACT

An inkjet recording apparatus has: a head having a plurality of nozzles which eject an ink onto a recording medium; a conveyance device which conveys the recording medium; a droplet ejection control device which controls ink ejection of the head; a test image forming device that forms a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed; and a reading device which is provided on a conveyance path of the recording medium, reads in a test image on the recording medium and has an image reading structure covering a length corresponding to full width of the recording medium in a breadthways direction which is perpendicular to the direction in which the recording medium is conveyed, wherein in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

25 Claims, 20 Drawing Sheets

INKJET RECORDING APPARATUS, TEST IMAGE FORMING METHOD, AND COMPUTER-READABLE MEDIUM

BACKGROUND OF THE INVENTION

1. Field of the Invention

The present invention relates to an inkjet recording apparatus, a test image forming method and a computer-readable medium, and more particularly to an in-line inspection and an ejection abnormality determination technology for an image determination apparatus of an inkjet recording apparatus or the like.

2. Description of the Related Art

Conventionally, it is suitable to use an inkjet recording apparatus as a general image forming apparatus. An inkjet recording apparatus forms a color image on a recording medium by ejecting colored inks of black, cyan, magenta, yellow, and the like, from a plurality of nozzles provided in an inkjet head. However, in an inkjet recording apparatus, if an ejection abnormality occurs, such as an ejection failure in which ink is not ejected, an abnormality in the direction of flight, an abnormality in the ejection volume, or the like, then the quality of the image declines markedly. In particular, in single-pass image forming using a full line head having nozzle rows of a length corresponding to the full width of the recording medium, if an ejection abnormality such as that described above occurs, then a white stripe following the conveyance direction arises in the recording medium and marked decline in quality occurs in the recorded image. Various methods for judging the presence or absence of ejection abnormalities in an inkjet recording apparatus have been proposed.

For example, there is a method which uses an in-line inspection apparatus using a CCD (Changed Coupled Device) having a structure in which photocells are arranged in a direction perpendicular to the scanning direction (conveyance direction) of the recording medium that is the object of inspection, a test pattern is printed on the recording medium, the test pattern is read in by the in-line inspection apparatus, and ejection abnormalities are judged from the read results.

The line inkjet printer disclosed in Japanese Patent Application Publication No. 2004-9474 is an inkjet printer which carries out printing with a fixed print head having a greater width than the printing width of the printing paper, having a composition whereby a test pattern printed in a portion of the paper by displacing the ejection nozzles by a uniform interval is read in by a scanner unit, and checking of ejection failures for all of the nozzles is carried out for each plurality of pages or each page.

However, in order to judge accurately the presence or absence of an ejection abnormality for each nozzle, it is necessary to prepare a line CCD having a higher reading resolution than the print resolution, but a high-resolution line CCD requires a longer time to read in the determination signal than a low-resolution line CCD, and hence there are concerns about decline in the determination efficiency. Furthermore, a high-resolution line CCD is expensive and is therefore unbeneficial from the viewpoint of cost. On the other hand, if a low-resolution line CCD is used, there may be a plurality of dots in the determination area of one element and therefore it is extremely difficult to determine ejection for each respective nozzle (each dot).

In the invention described in Japanese Patent Application Publication No. 2004-9474, the image is read in by a scanner unit having a reading resolution which is equal to or higher than the printing resolution, and Japanese Patent Application Publication No. 2004-9474 makes absolutely no mention of a case where a scanner unit having a lower reading resolution than the printing resolution is used.

In other words, Japanese Patent Application Publication No. 2004-9474 discloses a method in which a test pattern of vertical lines in a 1-on N-off arrangement (N=natural number) (namely, a test pattern comprising a plurality of lines extending in the conveyance direction of the paper printed by displacing the print nozzles) is printed in one portion of the paper, and the test pattern is read in and binarized; when the line scanning rate is 1 (msec/Line) and the paper feed rate is 1 (m/sec), then the width of the pattern is calculated to be 1 mm (=1(m/sec)×0.001 (sec/Line)), but it is not stated what value N is set to in cases where the printing resolution of the ejection nozzles and the reading resolution of the scanner unit are close to each other (or a case where the reading resolution of the scanner unit is finer than the printing resolution of the ejection nozzles) or cases where the reading resolution of the scanner unit is coarser than the printing resolution of the ejection nozzles.

If the reading resolution of the scanner unit is coarser than the printing resolution of the ejection nozzles, then a plurality of lines are read in by one determination element of the scanner unit, and as a result of this, there is a possibility that the position of a nozzle suffering ejection failure cannot be identified. If the reading resolution of the scanner unit is not sufficiently large, then one pixel of the inspection sensor also include the next pixel of the image, and hence there is a possibility that a nozzle suffering ejection failure cannot be identified in the conveyance direction either.

In other words, if the length is insufficient in the paper conveyance direction, then this means that two patterns are read in by one determination element, and hence a nozzle suffering ejection failure cannot be identified.

Moreover, if there is change in the size of the ejected droplets or their direction of flight, in either the main scanning direction (the breadthways direction of the paper, X direction) or the sub-scanning direction (the conveyance direction, Y direction), or if the position of the ejection head is displaced with respect to the paper, the interval of the test pattern in the X direction which is set once, in other words, the number N in the 1-on N-off arrangement, becomes inappropriate, and there is a possibility that a plurality of ejected droplets can be included in one inspection pixel of the scanner unit. Even after the length of the test pattern in the Y direction has been set to a state whereby only the ejection from one nozzle is contained in one inspection pixel of the scanner unit, if deviation occurs in the droplet ejection size or direction or the position of the ejection head, then there is a possibility that the state changes to one where the droplet ejection from a plurality of nozzles is contained in one inspection pixel of the scanner unit and hence the nozzles cannot be identified.

SUMMARY OF THE INVENTION

The present invention has been contrived in view of these circumstances, an object thereof being to provide an inkjet recording apparatus, a test image forming method and a computer-readable medium, whereby the presence or absence of ejection abnormality can be judged individually for each nozzle, using a reading device having a sufficiently lower resolution than the recording resolution of the image.

In order to attain an object described above, one aspect of the present invention is directed to an inkjet recording apparatus comprising: a head having a plurality of nozzles which eject an ink onto a recording medium; a conveyance device which conveys the recording medium; a droplet ejection control device which controls ink ejection of the head; a test image forming device that forms a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed; and a reading device which is provided on a conveyance path of the recording medium, reads in a test image on the recording medium and has an image reading structure covering a length corresponding to full width of the recording medium in a breadthways direction which is perpendicular to the direction in which the recording medium is conveyed, wherein in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

According to this aspect of the invention, it is possible to form a test image which is little affected by positional variation of the test image due to variation in the conveyance of the recording medium, when reading the test image using a reading device having a reading resolution lower than the droplet ejection resolution of the head, by setting optimal conditions for the test image through altering the X-direction and Y-direction separation intervals between the plurality of vertical lines which constitute the test image, and altering the Y-direction length of the vertical lines, on the basis of the droplet ejection pitch of the head (nozzles) and the reading pitch of the reading device. Therefore, the reliability of reading of the test image is improved and reading errors can be reduced.

In other words, in determining ejection abnormalities using a test image constituted by forming one vertical line from one nozzle, two or more vertical lines formed by ink ejected from respective nozzles never enter into the reading region of one reading element, and therefore abnormalities can be judged respectively for each vertical line and the presence or absence of ejection abnormalities can be judged for each nozzle respectively.

In other words, by setting the relationship between the arrangement pitch $P_{TX}$ of the vertical lines and the X-direction reading pitch $P_{SX}$ of the reading device (the X-direction arrangement pitch of the determination elements) to be $P_{TX}>P_{SX}$ in the X direction perpendicular to the direction of conveyance of the recording medium, either one vertical line or no vertical line is present in one reading region in the X direction.

Furthermore, by setting the relationship between the arrangement pitch $P_{TY}$ of the vertical lines and the Y-direction reading pitch $P_{SY}$ of the reading device in the Y direction which is parallel to the conveyance direction of the recording medium to be $P_{TY}=P_{SY}\times N$ (where N is a natural number), and aligning the periodicity of the Y-direction arrangement pitch of the vertical lines with the Y-direction reading period, then it is possible to achieve a state where either one vertical line or no vertical line is present in one reading region in the Y direction.

Moreover, by providing an interval having a Y-direction length of W in such a manner that the Y-direction length $L_Y$ of the vertical lines is $L_y=P_{SY}-W$, then if there is deviation in the Y-direction position of the recording medium (in other words, the Y-direction position of the test image) due to the occurrence of variation in the conveyance of the recording medium, it is possible to read in the test image in a desirable fashion without being affected by the variation in the conveyance of the recording medium.

The terms "(droplet) ejection", "discharging", and other similar meaning terms have the same or similar concepts, and these terms are used with no distinction in some parts of the specification/claims/drawings.

The image reading structure contained in the reading device may comprise reading elements and an optical system such as a condensing lenses (reducing lenses), or the like, whereby the whole width of the recording medium can be read.

In order to attain an object described above, another aspect of the present invention is directed to an inkjet recording apparatus comprising: a head having a plurality of nozzles which eject an ink onto a recording medium; a conveyance device which conveys the recording medium; a droplet ejection control device which controls ink ejection of the head; a test image forming device that forms a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed; and a reading device which is provided on a conveyance path of the recording medium, reads in a test image on the recording medium and has an image reading structure covering a length corresponding to full width of the recording medium in a breadthways direction which is perpendicular to the direction in which the recording medium is conveyed, wherein in the test image, an arrangement pitch in the X direction of the vertical lines is equal to or exceeding a reading pitch in the X direction of the reading device, an arrangement pitch in the Y direction of the vertical lines is twice or more than twice a reading pitch in the Y direction of the reading device, and an interval corresponding to variation in a conveyance of the recording medium is provided between the vertical lines in such a manner that a length in the Y direction of each of the vertical lines is less than the reading pitch in the Y direction of the reading device.

According to this aspect of the invention, in determining ejection abnormalities using a test image constituted by forming one vertical line from one nozzle, two or more vertical lines formed by ink ejected from respective nozzles never enter into the reading region of one reading element, and therefore abnormalities can be judged respectively for each vertical line and the presence or absence of ejection abnormalities can be judged for each nozzle respectively.

In other words, by setting the relationship between the arrangement pitch $P_{TX}$ of the vertical lines and the X-direction reading pitch of the reading device (the X-direction arrangement pitch of the determination elements) to be $P_{TX}>P_{SX}$ in the X direction perpendicular to the direction of conveyance of the recording medium, either one vertical line or no vertical line is present in one reading region in the X direction.

Furthermore, if the relationship in the arrangement pitch $P_{TY}$ of the vertical lines and the Y-direction reading pitch $P_{SY}$ of the reading device in respect of the Y direction which is parallel to the direction of conveyance of the recording medium is $P_{TY}>P_{SY}\times N'$ (where $N'>2$), and a blank row (a region where vertical lines are not present) having a Y-direction length equal to or greater than the Y-direction reading pitch is provided in the Y direction, then it is possible to ensure that only one vertical line or no vertical line is present in one reading region in the Y direction.

Moreover, by providing an interval having a Y-direction length of W in such a manner that the Y-direction length $L_Y$ of the vertical lines is $L_Y=P_{SY}-W$, then if there is deviation in the Y-direction position of the recording medium (in other words, the Y-direction position of the test image) due to the occurrence of variation in the conveyance of the recording medium, it is possible to read in the test image in a desirable fashion without being affected by the variation in the conveyance of the recording medium.

Desirably, the arrangement pitch in the Y direction of the vertical lines is n times the reading pitch in the Y direction of the reading device (where n is a natural number equal to 2 or higher).

According to this aspect of the invention, by setting the relationship between the arrangement pitch $P_{TY}$ of the vertical lines and the Y-direction reading pitch $P_{SY}$ of the reading device in the Y direction to be $P_{TY}=P_{SY}\times N$ (where N is a natural number), and aligning the periodicity of the Y-direction arrangement pitch of the vertical lines with the Y-direction reading period, then it is possible more reliably to achieve a state where either one vertical line or no vertical line is present in one reading region in the Y direction.

Desirably, the arrangement pitch in the X direction of the vertical lines is m times the reading pitch in the X direction of the reading device (where m is an integer equal to 2 or higher).

According to this aspect of the invention, by further aligning the periodicity of the X-direction arrangement pitch of the vertical lines with the reading period in the X direction, then it is possible more reliably to achieve a state where either one vertical line or no vertical line is present in one reading region in the X direction.

Desirably, the droplet ejection control device controls the ink ejection of the head in such a manner that a formation start position for the test image on the recording medium coincides with a reading start position of the reading device on the recording medium.

According to this aspect of the invention, by aligning the phase of the reading period of the reading device and the period of the vertical lines constituting the test image, it is possible more reliably to achieve a state where one or fewer vertical line is present in one reading region.

Desirably, the test image forming device forms the test image in such a manner that the vertical lines have alteration in the length in the Y direction; the reading device reads in the vertical lines having the alteration in the length in the Y direction; the inkjet recording apparatus comprises a calculation device which determines an optimal length for the vertical lines for which intensity of a read signal obtained from the reading device indicates a maximum value; and the droplet ejection control device controls the ink ejection of the head in such a manner that the length in the Y direction of the vertical lines is the optimal length determined by the calculation device.

According to this aspect of the invention, it is possible to reduce reading error by setting an optimal length which suits the reading sensitivity of the reading device as the Y-direction length of the vertical lines.

Desirably, the test image is formed on a non-image portion of the recording medium provided to at least one of an upstream side or a downstream side in the Y direction of an image region of the recording medium where an actual image is formed.

According to this aspect of the invention, by forming a test image either preceding or following the actual image, then it is possible to perform in-line determination during formation of an actual image, and it is possible to reflect the determination results using a test image preceding the actual image, in the formation of the directly following actual image.

Desirably, the heads are provided respectively for a plurality of colors; and the test image is formed in such a manner that vertical lines of different colors are formed in one determination region.

According to this aspect of the invention, it is possible to read in test images for a plurality of heads simultaneously, and therefore improvement in the reading efficiency of the test images can be expected.

A desirable mode is one in which a reading device(s) which is compatible with the reading of a plurality of colors is provided.

Desirably, the heads are provided respectively for a plurality of colors; and the test image is formed separately for each of the heads.

According to this aspect of the invention, test images are read in for respective heads (respective colors), and therefore improvement in the reading accuracy of the test images can be expected.

Desirably, the inkjet recording apparatus comprises an abnormality judgment device which judges presence or absence of an abnormal nozzle in the head, according to results of reading in the test image by the reading device.

According to this aspect of the invention, it is possible to judge the presence or absence of an abnormality, for each nozzle respectively.

An abnormality in a nozzle means an ejection abnormality, for example, an ejection failure in which no ink is ejected from a nozzle, or an abnormality relating to droplet ejection such as an abnormality in the ink ejection volume or an abnormality in the ejection position, or the like.

Desirably, the inkjet recording apparatus comprises an image correction device which corrects image data in cases where the abnormality judgment device judges that the abnormal nozzle is present in the head, wherein the droplet ejection control device controls the ink ejection of the head according to the image data corrected by the image correction device.

According to this aspect of the invention, a composition is adopted in which image correction is carried out when an abnormal nozzle has been determined, and therefore decline in image quality due to an abnormality in a nozzle is prevented.

Examples of the image processing include processing for changing the image data (dot data) or changing the ink droplet ejection size, in such a manner that substitute droplet ejection is performed from a nozzle or nozzles adjacent to the abnormal nozzle.

Desirably, the inkjet recording apparatus comprises a restoration processing device which, in cases where the abnormality judgment device judges that the abnormal nozzle is present in the head, carries out restoration processing on a nozzle which the abnormality judgment device judges as the abnormal nozzle.

According to this aspect of the invention, restoration processing is carried out in respect of an abnormal nozzle, and therefore decline in image quality due to an abnormality in a nozzle is prevented.

Examples of the restoration processing include preliminary ejection processing (flushing) for ejecting degraded ink which is the cause of an abnormality out from the nozzle, or a suctioning process for suctioning degraded ink via the nozzle.

In order to attain an object described above, another aspect of the present invention is directed to a test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of: controlling ink ejection of the head so as to form a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed, in such a manner that, in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

In an inkjet recording apparatus, it is possible to carry out a nozzle abnormality determination method comprising a reading step of reading in a test image formed in accordance with the test image forming method, and an abnormality judgment step of judging the presence or absence of abnormality for each nozzle on the basis of the reading results.

Furthermore, in the nozzle abnormality determination method described above, a desirable mode is one which includes an image correction step of correcting the image data in cases where an abnormality is determined in a nozzle, and a restoration processing step of carrying out restoration processing in respect of the abnormal nozzle.

In order to attain an object described above, another aspect of the present invention is directed to a test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of: controlling ink ejection of the head so as to form a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed, in such a manner that, in the test image, an arrangement pitch in the X direction of the vertical lines is equal to or exceeding a reading pitch in the X direction of the reading device, an arrangement pitch in the Y direction of the vertical lines is twice or more than twice a reading pitch in the Y direction of the reading device, and an interval corresponding to variation in a conveyance of the recording medium is provided between the vertical lines in such a manner that a length in the Y direction of each of the vertical lines is less than the reading pitch in the Y direction of the reading device.

In order to attain an object described above, another aspect of the present invention is directed to a computer-readable medium storing instructions to cause a computer to execute at least a test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of: controlling ink ejection of the head so as to form the test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which each extend continuously in terms of a Y direction parallel to the direction in which the recording medium is conveyed and shift by one nozzle in the X direction, in such a manner that, in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

Such a test image forming program may be stored internally in the apparatus in which the test image forming program is applied, or it may be stored in a storage medium which can be separated from this apparatus.

In order to attain an object described above, another aspect of the present invention is directed to a computer-readable medium storing instructions to cause a computer to execute at least a test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of: controlling ink ejection of the head so as to form the test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which each extend continuously in terms of a Y direction parallel to the direction in which the recording medium is conveyed and shift by one nozzle in the X direction, in such a manner that, in the test image, an arrangement pitch in the X direction of the vertical lines is equal to or exceeding a reading pitch in the X direction of the reading device, an arrangement pitch in the Y direction of the vertical lines is twice or more than twice a reading pitch in the Y direction of the reading device, and an interval corresponding to variation in a conveyance of the recording medium is provided between the vertical lines in such a manner that a length in the Y direction of each of the vertical lines is less than the reading pitch in the Y direction of the reading device.

According to the present invention, by setting optimal conditions of a test image through altering the X-direction and Y-direction separation intervals between a plurality of vertical lines which constitute a test image, and altering the Y-direction length of the vertical lines, on the basis of the droplet ejection pitch of the head (nozzles) and the reading pitch of the reading device, it is possible to form a test image which is little affected by positional variation of the test image caused by variation in the conveyance of the recording medium, and hence the reliability of the reading of the test image is improved and reading error can be reduced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Composition of Apparatus

Figure 1:
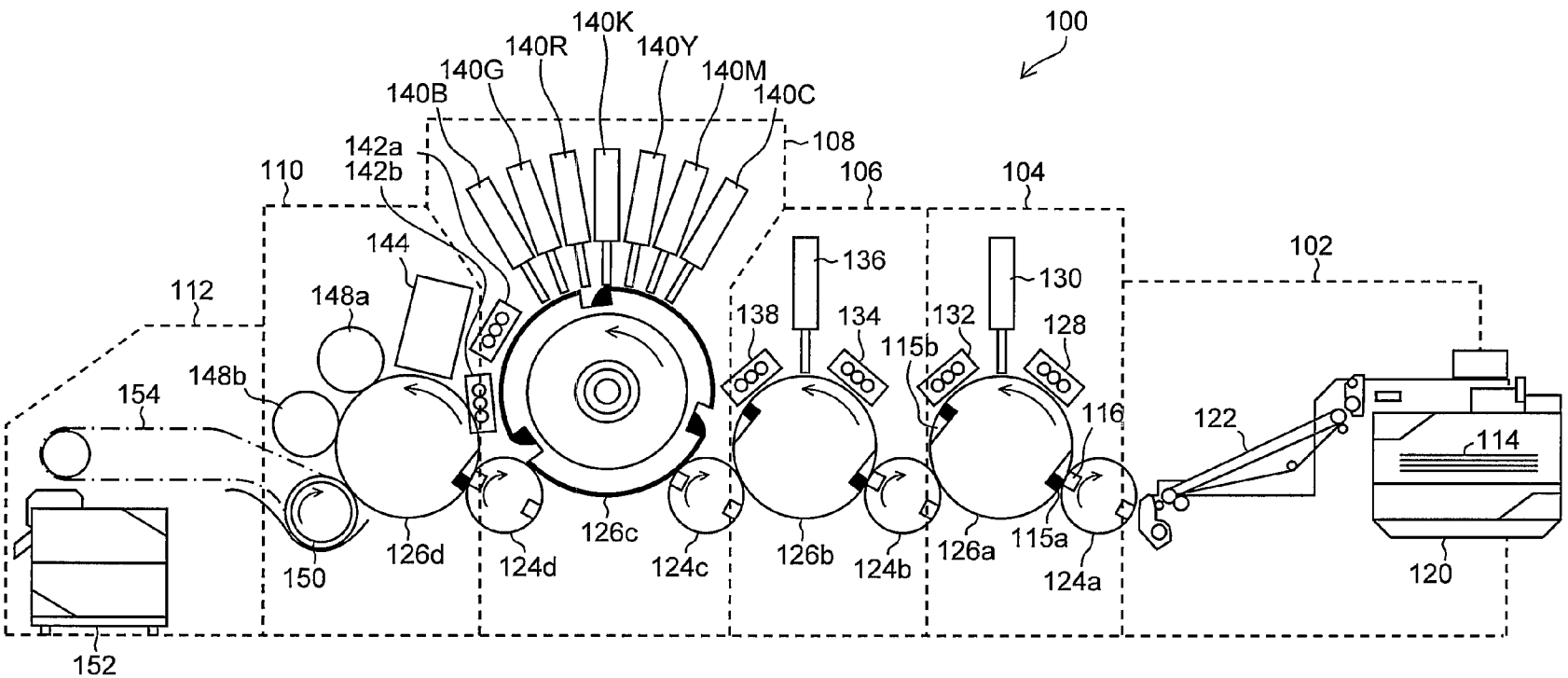
FIG. 1 is a general schematic drawing of an inkjet recording apparatus relating to an embodiment of the present invention.

The inkjet recording apparatus (image recording apparatus) 100 illustrated in FIG. 1 is a single side machine which is capable of printing only onto one surface of the recording medium 114. The inkjet recording apparatus 100 principally comprises: a paper supply unit 102 which supplies a recording medium 114; a permeation suppression processing unit 104 which carries out permeation suppression processing on the recording medium 114; a treatment agent deposition unit 106 which deposits treatment agent onto the recording medium 114; a print unit 108 which forms an image by depositing colored ink onto the recording medium 114; a fixing treatment unit 110 which carries out a fixing process so that an image recorded on the recording medium 114 is fixed; and a paper output unit 112 which conveys and outputs the recording medium 114 on which an image has been formed.

A paper supply platform 120 on which recording media 114 is stacked is provided in the paper supply unit 102. A feeder board 122 is connected to the front of the paper supply platform 120 (the left-hand side in FIG. 1), and the recording media 114 stacked on the paper supply platform 120 is supplied one sheet at a time, successively from the uppermost sheet, to the feeder board 122. A recording medium 114 which has been conveyed to the feeder board 122 is supplied via a transfer drum 124*a*, which is rotatable in the clockwise direction in FIG. 1, to the surface (circumferential surface) of a pressure drum 126*a* of the permeation suppression processing unit 104.

Grippers (not illustrated) for holding an edge of a recording medium 114 are provided on the transfer drum 124*a* and pressure drum 126*a*. When an edge of a recording medium held by a gripper of the transfer drum 124*a* reaches a place where the recording medium 114 is transferred between the transfer drum 124*a* and the pressure drum 126*a*, the edge of the recording medium is transferred from the gripper of the transfer drum 124*a* to a gripper of the pressure drum 126*a*. In the present example, two grippers are provided on one pressure drum 126, and one gripper is provided on one transfer drum 124.

In the permeation suppression processing unit 104, a paper preheating unit 128, a permeation suppressing agent head 130 and a permeation suppressing agent drying unit 132 are provided respectively at positions opposing the surface (circumferential surface) of the pressure drum 126*a*, in this order from the upstream side in terms of the direction of rotation of the pressure drum 126*a* (the conveyance direction of the recording medium 114; the counter-clockwise direction in FIG. 1).

Heaters which can be temperature-controlled respectively within a prescribed range are provided in the paper preheating unit 128 and the permeation suppression agent drying unit 132. When the recording medium 114 held on the pressure drum 126*a* passes the positions opposing the paper preheating unit 128 and the permeation suppression agent drying unit 132, it is heated by the heaters of these units.

The permeation suppression agent head 130 ejects droplets of a permeation suppression agent onto a recording medium 114 which is held on the pressure drum 126*a* and adopts the same composition as the ink heads 140C, 140M, 140Y, 140K, 140R, 140G and 140B of the print unit 108, which is described below.

In the present embodiment, an inkjet head is used as the device for carrying out permeation suppression processing on the surface of the recording medium 114, but there are no particular restrictions of the device which carries out permeation suppression processing. For example, it is also possible to use various other methods, such as a spray method, application method, and the like.

In the present embodiment, it is desirable to use a thermoplastic resin latex solution as the permeation suppression agent. Of course, the permeation suppression agent is not limited to being a thermoplastic resin latex solution, and for example, it is also possible to use a flat sheet-shaped particles (mica, or the like), or a hydrophobic agent (a fluorine coating agent), or the like.

A treatment liquid deposition unit 106 is provided after the permeation suppression processing unit 104 (to the downstream side of same in terms of the direction of conveyance of the recording medium 114). A transfer drum 124*b* is provided between the pressure drum 126*a* of the permeation suppression processing unit 104 and the pressure drum 126*b* of the treatment liquid deposition unit 106, so as to make contact with same. By adopting this structure, after the recording medium 114 which is held on the pressure drum 126*a* of the permeation suppression processing unit 104 has been subjected to permeation suppression processing, the recording medium 114 is transferred via the transfer drum 124*b*, which is rotatable in the clockwise direction in FIG. 1, to the pressure drum 126*b* of the treatment liquid deposition unit 106.

In the treatment liquid deposition unit 106, a paper preheating unit 134, a treatment liquid head 136 and a treatment liquid drying unit 138 are provided respectively at positions opposing the surface of the pressure drum 126*b*, in this order from the upstream side in terms of the direction of rotation of the pressure drum 126*b* (the counter-clockwise direction in FIG. 1).

The respective units of the treatment liquid deposition unit 106 (namely, the paper preheating unit 134, the treatment liquid head 136 and the treatment liquid drying unit 138) use similar compositions to the paper preheating unit 128, the permeation suppression agent head 130 and the permeation suppression agent drying unit 132 of the permeation suppression processing unit 104 which is described above, and the explanation of those units is omitted here. Of course, it is also possible to employ different compositions from the permeation suppression processing unit 104.

The treatment liquid used in the present embodiment is an acidic liquid which has the action of aggregating the coloring material contained in the inks which are ejected onto the recording medium 114 from respective ink heads 140C, 140M, 140Y, 140K, 140R, 140G and 140B provided in the print unit 108 which is disposed at a downstream stage from the treatment liquid deposition unit 106.

The heating temperature of the heater of the treatment liquid drying unit 138 is set to a temperature at which the treatment liquid which has been deposited onto the surface of the recording medium 114 by the ejection operation of the treatment liquid head 136 disposed to the upstream side in terms of the direction of rotation of the pressure drum 126*b* is dried, and a solid or semi-solid aggregating treatment agent layer (a thin film layer of dried treatment liquid) is formed on the recording medium 114.

Reference here to "aggregating treatment agent layer in a solid state or a semi-solid state" includes a layer having a liquid content of 0% to 70% as defined below.

"Moisture content ratio"="Weight per unit surface area of water contained in treatment liquid after drying ($g/m^2$)"/"Weight per unit surface area of treatment liquid after drying ($g/m^2$)" Expression 1

A desirable mode is one in which the recording medium 114 is preheated by the heater of the paper preheating unit 134, before depositing treatment liquid on the recording medium 114, as in the present embodiment. In this case, it is possible to restrict the heating energy required to dry the treatment liquid to a low level, and therefore energy savings can be made.

A print unit 108 is provided after the treatment liquid deposition unit 106. A transfer drum 124*c*, which is composed rotatably in the clockwise direction in FIG. 1, is provided between the pressure drum 126*b* of the treatment liquid deposition unit 106 and the pressure drum 126*c* of the print unit 108, so as to make contact with same. By means of this structure, treatment liquid is deposited onto the recording medium 114 held on the pressure drum 126*b* of the treatment liquid deposition unit 106, thereby forming a solid or semi-solid layer of aggregating treatment agent, whereupon the recording medium 114 is transferred via the transfer drum 124*c* to the pressure drum 126*c* of the print unit 108.

In the print unit 108, ink heads 140C, 140M, 140Y, 140K, 140R, 140G and 140B which correspond respectively to the seven colors of ink, C (cyan), M (magenta), Y (yellow), K (black), R (red), G (green) and B (blue), and solution drying units 142*a* and 142*b* are provided respectively at positions opposing the surface of the pressure drum 126*c*, in this order from the upstream side in terms of the direction of rotation of the pressure drum 126*c* (the counter-clockwise direction in FIG. 1).

The ink heads 140C, 140M, 140Y, 140K, 140R, 140G and 104B employ inkjet type recording heads (inkjet heads), similarly to the permeation suppression agent head 130 and the treatment liquid head 136. In other words, the ink heads 140C, 140M, 140Y, 140K, 140R, 140G and 140B respectively eject droplets of corresponding colored inks onto a recording medium 114 which is held on the pressure drum 126*c*.

Figure 2:
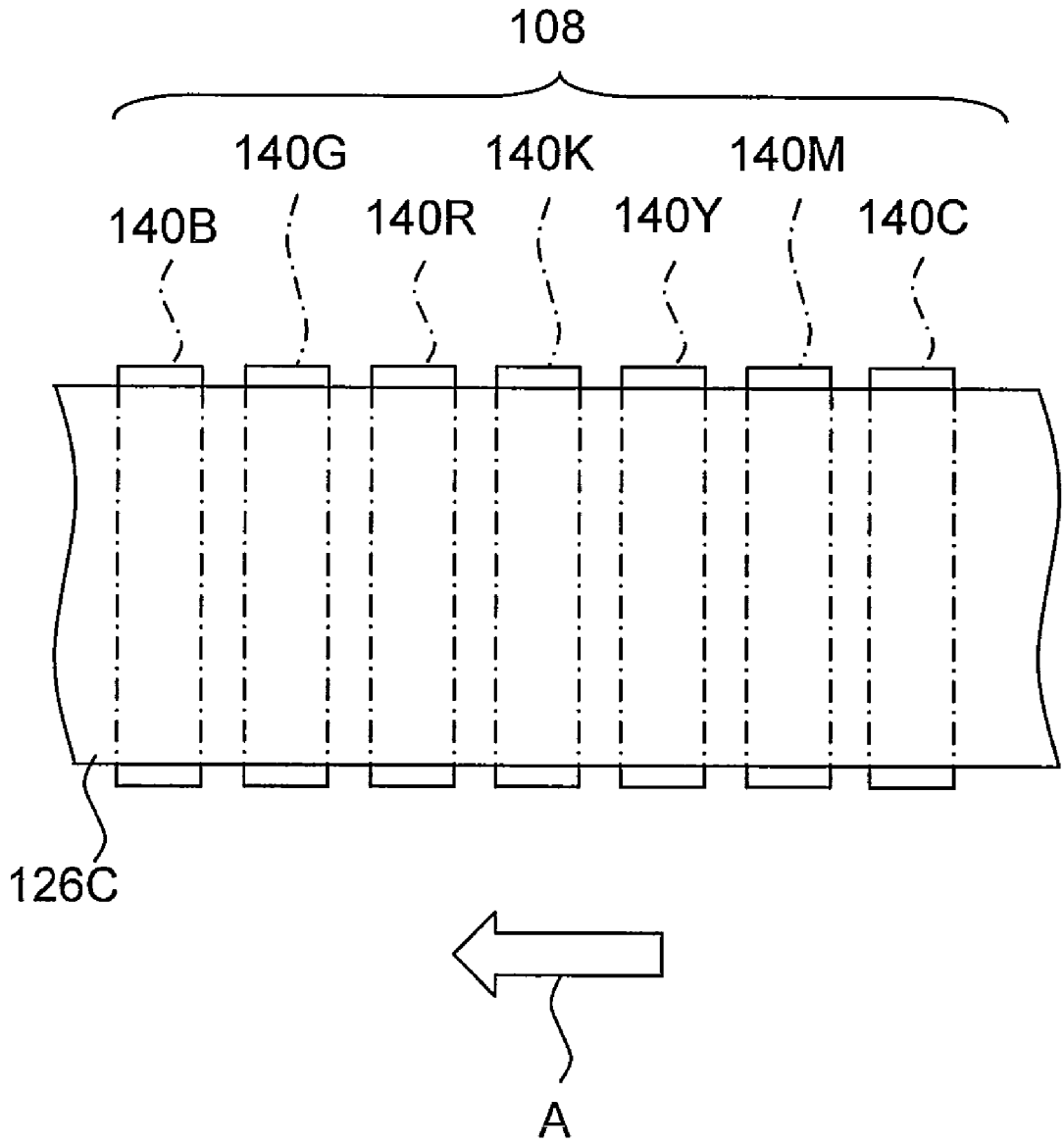
FIG. 2 is a principal plan diagram of the peripheral area of a print unit in the inkjet recording apparatus illustrated in FIG. 1.

The ink heads 140C, 140M, 140Y, 140K, 140R, 140G and 140B are each full-line heads having a length corresponding to the maximum width of the image forming region of the recording medium 114 held on the pressure drum 126*c*, and having a plurality of nozzles for ejecting ink (not illustrated in FIG. 1 and indicated by reference numeral 161 in FIGS. 13A to 13C) arranged through the full width of the image forming region, on the ink ejection surface of the head. The ink heads 140C, 140M, 140Y, 140K, 140R, 140G and 140B are fixed so as to extend in a direction that is perpendicular to the direction of rotation of the pressure drum 126*c* (the conveyance direction of the recording medium 114) (see FIG. 2).

According to a composition in which such full line heads having nozzle rows which cover the full width of the image forming region of the recording medium 114 are provided for each color of ink, it is possible to record a primary image on the image forming region of the recording medium 114 by performing just one operation of moving the recording medium 114 and the ink heads 140C, 140M, 140Y, 140K, 140R, 140G and 140B relatively with respect to each other (in other words, by one sub-scanning action). Therefore, it is possible to achieve a higher printing speed compared to a case which uses a serial (shuttle) type of head which moves back and forth reciprocally in the direction perpendicular to the conveyance direction of the recording medium 114 (sub-scanning direction), and hence it is possible to improve the print productivity.

Although the configuration with the CMYKRGB seven colors is described in the present embodiment, combinations of the ink colors and the number of colors are not limited to those. Light inks, dark inks or special color inks can be added or removed as required. For example, a configuration in which ink heads for ejecting light-colored inks such as light cyan and light magenta are added, or a configuration using the CMYK four colors is possible. Furthermore, there are no particular restrictions of the sequence in which the heads of respective colors are arranged.

The solution drying units 142*a* and 142*b* have a composition which comprises heater whose temperature can be controlled within a prescribed range, similarly to the paper preheating units 128 and 134, the permeation suppression agent drying unit 132, and the treatment liquid drying unit 138, which are described above. As described hereinafter, if ink droplets are ejected onto the layer of aggregating treatment agent in a solid state or semi-solid state which has been formed on the recording medium 114, an ink aggregate (coloring material aggregate) is formed on the recording medium 114, and furthermore, the ink solvent which has separated from the coloring material spreads and a liquid layer of dissolved aggregating treatment agent is formed. The solvent component (liquid component) left on the recording medium 114 in this way is a cause of curling of the recording medium 114 and also leads to deterioration of the image. Therefore, in the present embodiment, after ejecting droplets of the corresponding colored inks onto the recording medium 114 respectively from the ink heads 140C, 140M, 140Y, 140K, 140R, 140G and 140B, heating is carried out by the heaters of the solution drying units 142*a* and 142*b*, and the solvent component is evaporated off and dried.

The fixing processing unit 110 is provided subsequent to the print unit 108, and a transfer drum 124*d* is provided between the pressure drum 126*c* of the print unit 108 and the pressure drum 126*d* of the fixing processing unit 110 so as to make contact with the pressure drums. By this means, after the respective colored inks have been deposited on the recording medium 114 which is held on the pressure drum 126*c* of the print unit 108, the recording medium 114 is transferred via the transfer drum 124*d* to the pressure drum 126*d* of the fixing processing unit 110.

In the fixing processing unit 110, an in-line sensor 144 which reads in the print results of the print unit 108, and heating rollers 148*a* and 148*b* are provided respectively at positions opposing the surface of the pressure drum 126*d*, in this order from the upstream side in terms of the direction of rotation of the pressure drum 126*d* (the counter-clockwise direction in FIG. 1).

In the present embodiment, a mode based on application of heat and pressure is described as one example of a fixing device after image recording, but it is also possible to adopt other compositions, such as a composition in which a transparent ultraviolet-curable ink droplet ejection unit ejects droplets of transparent ultraviolet-curable ink, and the transparent ultraviolet-curable ink is cured and the image is thereby fixed onto the recording medium 114 by irradiating ultraviolet light thereon.

The in-line sensor 144 includes an image sensor (a line sensor, or the like) which captures the print result of the print unit 108 (the droplet ejection results of the respective ink heads 140C, 140M, 140Y, 140K, 140R, 140G and 140B), and functions as a device for checking for nozzle blockages and other ejection defects on the basis of the droplet ejection image read out by the image sensor.

In the present example, a test pattern is formed on the non-image portion of the recording medium 114 (see FIG. 8), the test pattern is read in by the in-line sensor 144, and in-line determination is carried out to determine the presence or absence of ejection abnormalities in the respective nozzles, on the basis of the reading results. Although the details are described hereinafter, the in-line sensor 144 employed in the present example comprises a line CCD in which a plurality of inspection pixels (read elements) are arranged in one row in the breadthways direction of the recording medium 114 (or an area sensor in which a plurality of inspection pixels are arranged in a two-dimensional configuration), and a condensing lens (reducing grass) disposed in such a manner that the line CCD (or area sensor) can read in the whole of the breadthways direction of the recording medium 114 at the same time. The in-line sensor 144 has a reading resolution that is sufficiently lower than the recording resolution of each of the ink heads 140C, 140M, 140Y, 140K, 140R, 140G and 140B of the print unit 108.

The paper output unit 112 is provided subsequent to the fixing processing unit 110. In the paper output unit 112, there are provided: a paper output drum 150 which receives a recording medium 114 subjected to fixing processing, a paper output platform 152 on which recording media 114 is stacked, and a paper output chain 154 comprising a plurality of paper output grippers, which are spanned between a sprocket provided on the paper output drum 150 and a sprocket provided above the paper output platform 152.

Next, the structure of the ink heads 140C, 140M, 140Y, 140K, 140R, 140G and 140B disposed in the print unit 108 will be described in detail. The ink heads 140C, 140M, 140Y, 140K, 140R, 140G and 140B have a common structure, and therefore, below, these heads are represented by an ink head (hereinafter, simply called a "head") which is indicated by reference numeral 160.

Figure 3A:
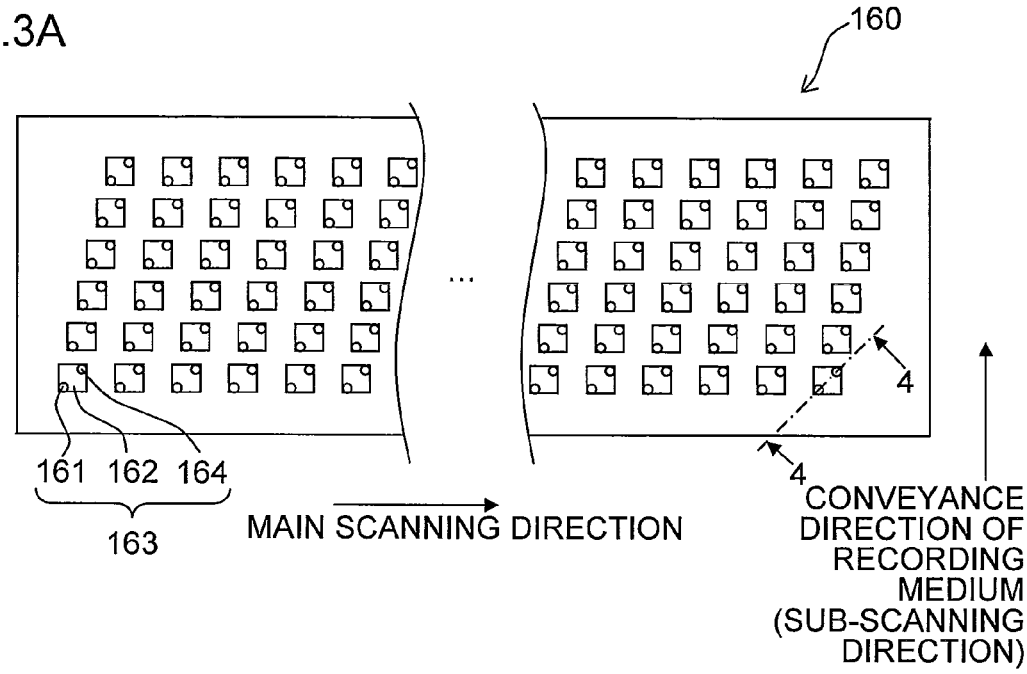
FIGS. 3A to 3C are plan view perspective diagrams illustrating examples of the head illustrated in FIG. 1.
Figure 3B:
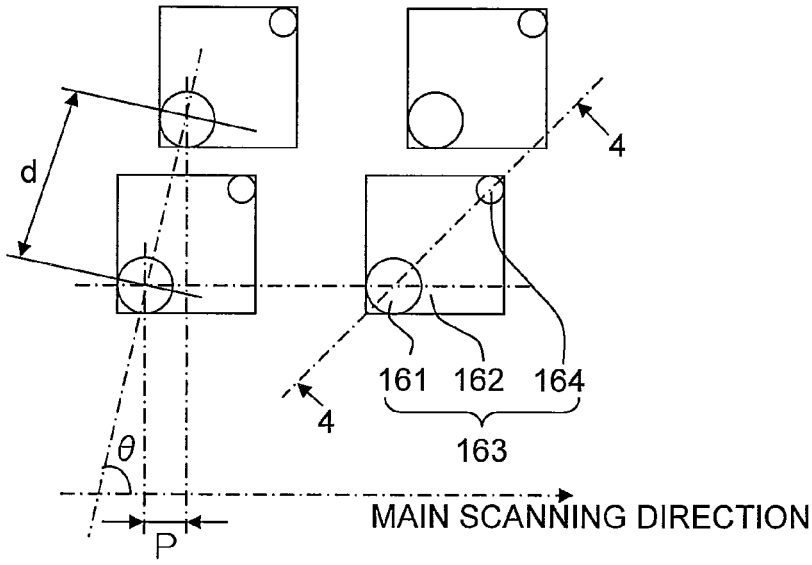
Figure 3C:
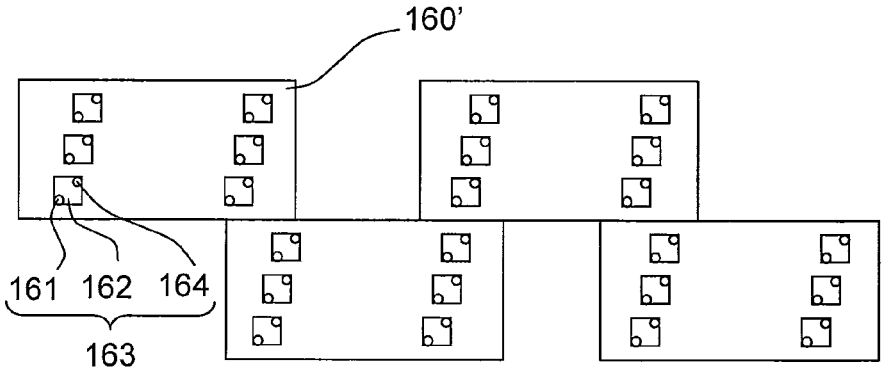
Figure 4:
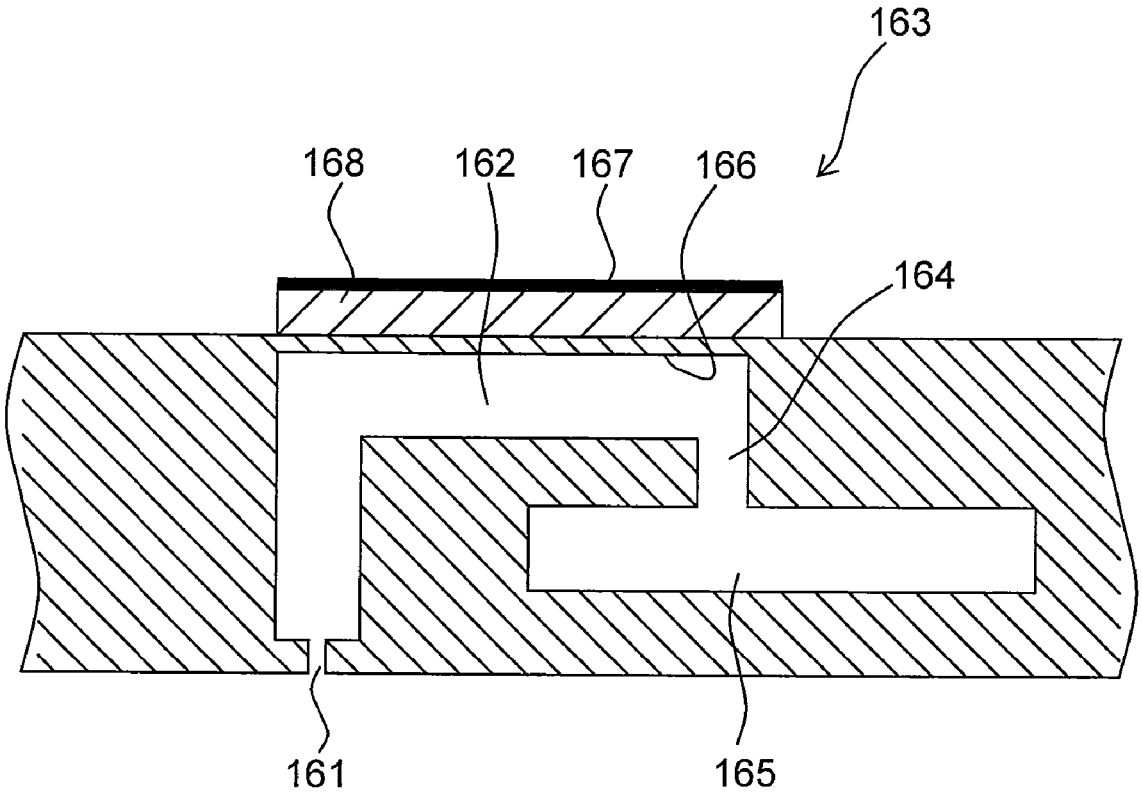
FIG. 4 is a cross-sectional diagram along line 4-4 in FIGS. 3A and 3B.

FIG. 3A is a perspective plan view illustrating an example of the configuration of a head 160, FIG. 3B is an enlarged view of a portion thereof. FIG. 3C is a perspective plan view illustrating another example of the configuration of the head 160. FIG. 4 is a cross-sectional view taken along the line 4-4 in FIGS. 3A and 3B, illustrating the cross sectional view structure of an ink chamber unit.

The nozzle pitch in the head 160 should be minimized in order to maximize the density of the dots formed on the surface of the recording medium 114. As illustrated in FIGS. 3A and 3B, the head 160 according to the present embodiment has a structure in which a plurality of ink chamber units 163, each comprising a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

The mode of forming one or more nozzle rows through a length corresponding to the entire width of the recording medium 114 in a direction substantially perpendicular to the conveyance direction of the recording medium 114 is not limited to the example described above. For example, instead of the configuration in FIG. 3A, as illustrated in FIG. 3C, a line head having nozzle rows of a length corresponding to the entire width of the recording medium 114 can be formed by arranging and combining, in a staggered matrix, short head blocks 160' having a plurality of nozzles 161 arrayed in a two-dimensional fashion. Furthermore, although not illustrated in the drawings, it is also possible to compose a line head by arranging short heads in one row.

The planar shape of the pressure chamber 162 provided for each nozzle 161 is substantially a square, and the nozzle 161 and supply port 164 are disposed in both corners on a diagonal line of the square. Each pressure chamber 162 is connected to a common channel 165 through the supply port 164. The common channel 165 is connected to an ink supplied tank (not illustrated), which is a base tank that supplies ink, and the ink supplied from the ink supplied tank is delivered through the common flow channel 165 to the pressure chambers 162.

A piezoelectric element 168 provided with an individual electrode 167 is bonded to a pressure plate 166 (a diaphragm that also serves as a common electrode) which forms the ceiling of each pressure chamber 162. When a drive voltage is applied to the individual electrode 167, the piezoelectric element 168 is deformed and the ink is thereby ejected through the nozzle 161. When ink is ejected, new ink is supplied to the pressure chamber 162 from the common flow channel 165 through the supply port 164.

In the present example, a piezoelectric element 168 is used as an ink ejection force generating device which causes ink to be ejected from a nozzle 160 provided in a head 161, but it is also possible to employ a thermal method in which a heater is provided inside each pressure chamber 162 and ink is ejected by using the pressure of the film boiling action caused by the heating action of this heater.

Figure 5:
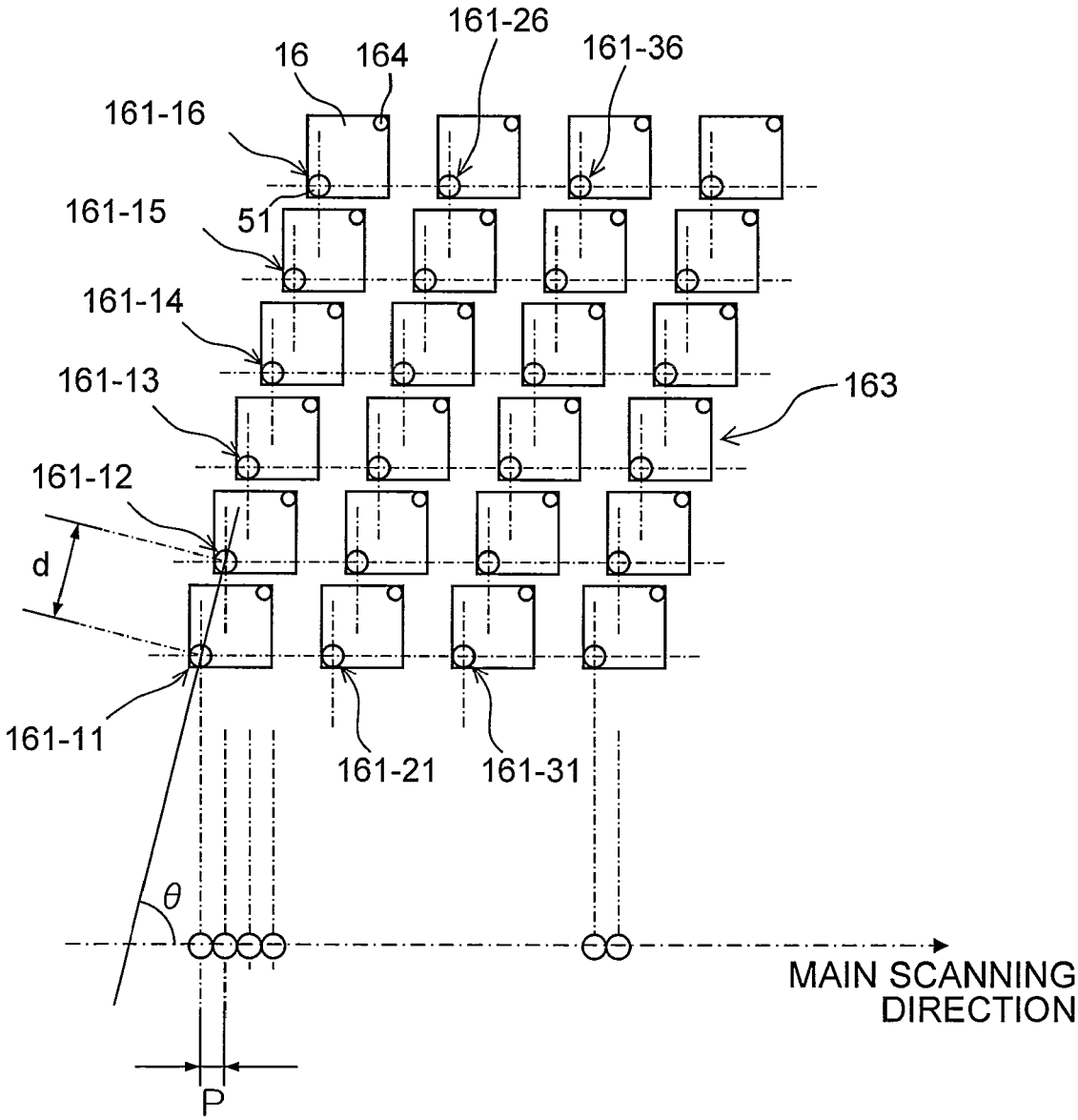
FIG. 5 is an enlarged view illustrating a nozzle arrangement in the print head illustrated in FIG. 3A.

As illustrated in FIG. 5, the high-density nozzle head according to the present embodiment is achieved by arranging a plurality of ink chamber units 163 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 163 are arranged at a uniform pitch d in line with a direction forming an angle of θ with respect to the main scanning direction, the pitch P of the nozzles projected so as to align in the main scanning direction is $d \times \cos\theta$, and hence the nozzles 161 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium 114 (the direction perpendicular to the conveyance direction of the recording medium 114) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 161 arranged in a matrix such as that illustrated in FIGS. 3A and 3B are driven, the main scanning according to the above-described (3) is preferred. More specifically, the nozzles 161-11, 161-12, 161-13, 161-14, 161-15 and 161-16 are treated as a block (additionally; the nozzles 161-21, 161-22, . . . , 161-26 are treated as another block; the nozzles 161-31, 161-32, . . . , 161-36 are treated as another block; . . . ); and one line is printed in the width direction of the recording medium 114 by sequentially driving the nozzles 161-11, 161-12, . . . , 161-16 in accordance with the conveyance velocity of the recording medium 114.

On the other hand, "sub-scanning" is defined as to repeatedly perform printing of one line (a line formed of a row of dots, or a line formed of a plurality of rows of dots) formed by the main scanning, while moving the full-line head and the recording medium 114 relatively to each other.

The direction indicated by one line (or the lengthwise direction of the band-shaped region thus recorded) recorded by the main scanning action is called the "main scanning direction", and the direction in which sub-scanning is performed is called the sub-scanning direction. Consequently, the conveyance direction of the recording medium 114 is the sub-scanning direction and the width direction of the recording medium 114 being perpendicular to the sub-scanning direction is called the main scanning direction. The arrangement of the nozzles of embodiments of the present invention is not limited to the arrangements illustrated in the drawings. Various nozzle arrangements, such as an arrangement of one nozzle row in the sub-scanning direction for example, can be employed.

Furthermore, the scope of application of the present invention is not limited to a printing system based on a line type of head, and it is also possible to adopt a serial system where a short head which is shorter than the breadthways dimension of the recording medium 114 is scanned (moved) in the breadthways direction (main scanning direction) of the recording medium 114, thereby performing printing in the breadthways direction, and when one printing action in the breadthways direction has been completed, the recording medium 114 is moved through a prescribed amount in the direction perpendicular to the breadthways direction (the sub-scanning direction), printing in the breadthways direction of the recording medium 114 is carried out in the next printing region, and by repeating this sequence, printing is performed over the whole surface of the printing region of the recording medium 114.

Figure 6:
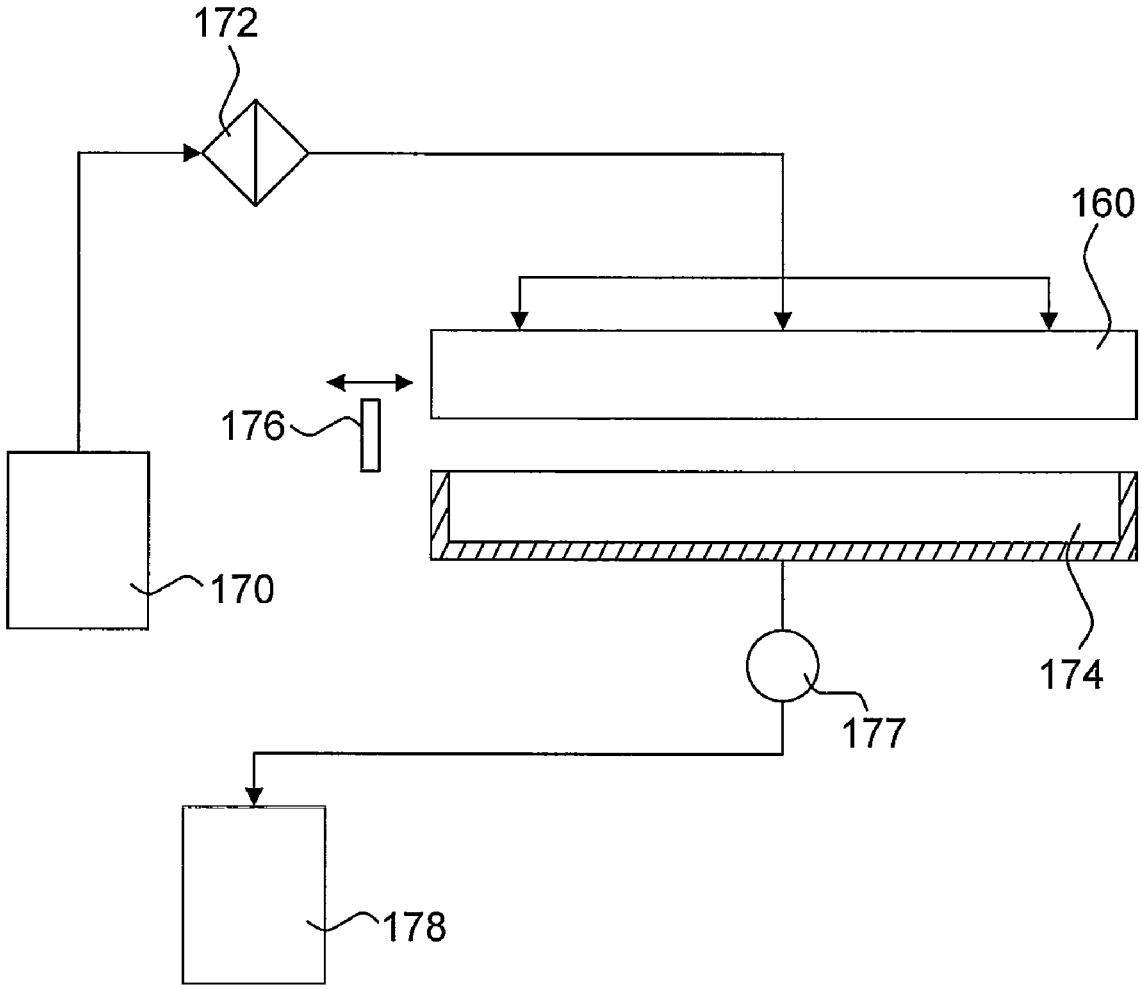
FIG. 6 is a schematic drawing illustrating the composition of an ink supply system in the inkjet recording apparatus illustrated in FIG. 1.

FIG. 6 is a schematic drawing illustrating the configuration of the ink supply system in the inkjet recording apparatus 100. The ink supply tank 170 is a base tank to supply ink to the print head 160 and is included in the ink storing and loading unit described above. The aspects of the ink supply tank 170 include a refillable type and a cartridge type: when the remaining amount of ink is low, the ink tank of the refillable type is filled with ink through a filling port (not illustrated) and the ink tank of the cartridge type is replaced with a new one. In order to change the ink type in accordance with the intended application, the cartridge type is suitable, and it is desirable to represent the ink type information with a bar code or the like, and to perform ejection control in accordance with the ink type.

A filter 172 for removing foreign matters and bubbles is disposed in the middle of the channel connecting the ink supply tank 170 and the print head 160 as illustrated in FIG. 6. The filter mesh size in the filter 62 is desirably equivalent to or not more than the diameter of the nozzle of print head and commonly about 20 μm.

Although not illustrated in FIG. 6, it is desirable to provide a sub-tank integrally to the print head 160 or nearby the print head 160. The sub-tank has a damper function for preventing variation in the internal pressure of the head and a function for improving refilling of the print head.

The inkjet recording apparatus 100 is also provided with a cap 174 as a device to prevent the nozzles from drying out or to prevent an increase in the ink viscosity in the vicinity of the nozzles, and a cleaning blade 176 as a device to clean the ink ejection surface of the head 160.

A maintenance unit including the cap 174 and the cleaning blade 176 can be relatively moved with respect to the print head 160 by a movement mechanism (not illustrated), and is moved from a place for recording to a place above the maintenance unit as required.

The cap 174 is displaced up and down relatively with respect to the print head 160 by an elevator mechanism (not illustrated). When the power of the inkjet recording apparatus 100 is turned OFF or when the apparatus 100 is in a standby state for printing, the elevator mechanism raises the cap 174 to a predetermined elevated position so as to come into close contact with the print head 160, and the nozzle region of the nozzle surface 50A is thereby covered by the cap 174.

During printing or during standby, if the use frequency of a particular nozzle 161 has declined and the non-ejection of the ink continues for over a certain time, then the ink solvent in the vicinity of nozzles evaporates off and thereby the ink viscosity in the vicinity of the nozzle has increased. Once the ink reaches the state of this kind, it is difficult to eject the ink from the nozzles 161 even if the piezoelectric elements 168 operate.

Therefore, before a situation of this kind develops (namely, while the ink is within a range of viscosity which allows it to be ejected by operation of a piezoelectric element 168), the piezoelectric element 168 is operated, and a preliminary ejection ("purge", "blank ejection", "liquid ejection" or "dummy ejection") is carried out toward the cap 174 (ink receptacle), in order to expel the degraded ink (namely, the ink in the vicinity of the nozzle which has increased viscosity).

Furthermore, if air bubbles enter into the ink inside the head 160 (inside the pressure chamber 162), then even if the piezoelectric element 168 is operated, it may not be possible to eject ink from the nozzle. In a case of this kind, the cap 174 is placed on the head 160, the ink (ink containing air bubbles) inside the pressure chamber 162 is removed by suction, by means of a suction pump 177, and the ink removed by suction is then supplied to a recovery tank 178.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 162, the ink consumption is considerably large. Therefore, a mode in which preliminary ejection is carried out when the increase in the viscosity of the ink is still minor, is desirable.

The cleaning blade 176 is composed of rubber or another elastic member, and can slide on the ink ejection surface of the print head 160 by means of a blade movement mechanism (not illustrated). When ink droplets or foreign matter has adhered to the ink ejection surface, the ink ejection surface is wiped and cleaned by sliding the cleaning blade 176 on the ink ejection surface.

The inkjet recording apparatus 100 according to the present embodiment is provided in such a manner a nozzle having an ejection abnormality is judged from the read results of the in-line sensor 144 (see FIG. 1) and this judged ejection abnormality nozzle is subject to the recovery treatment. The recovery treatment according to the present embodiment includes the preliminary ejection and suction described above.

Figure 7:
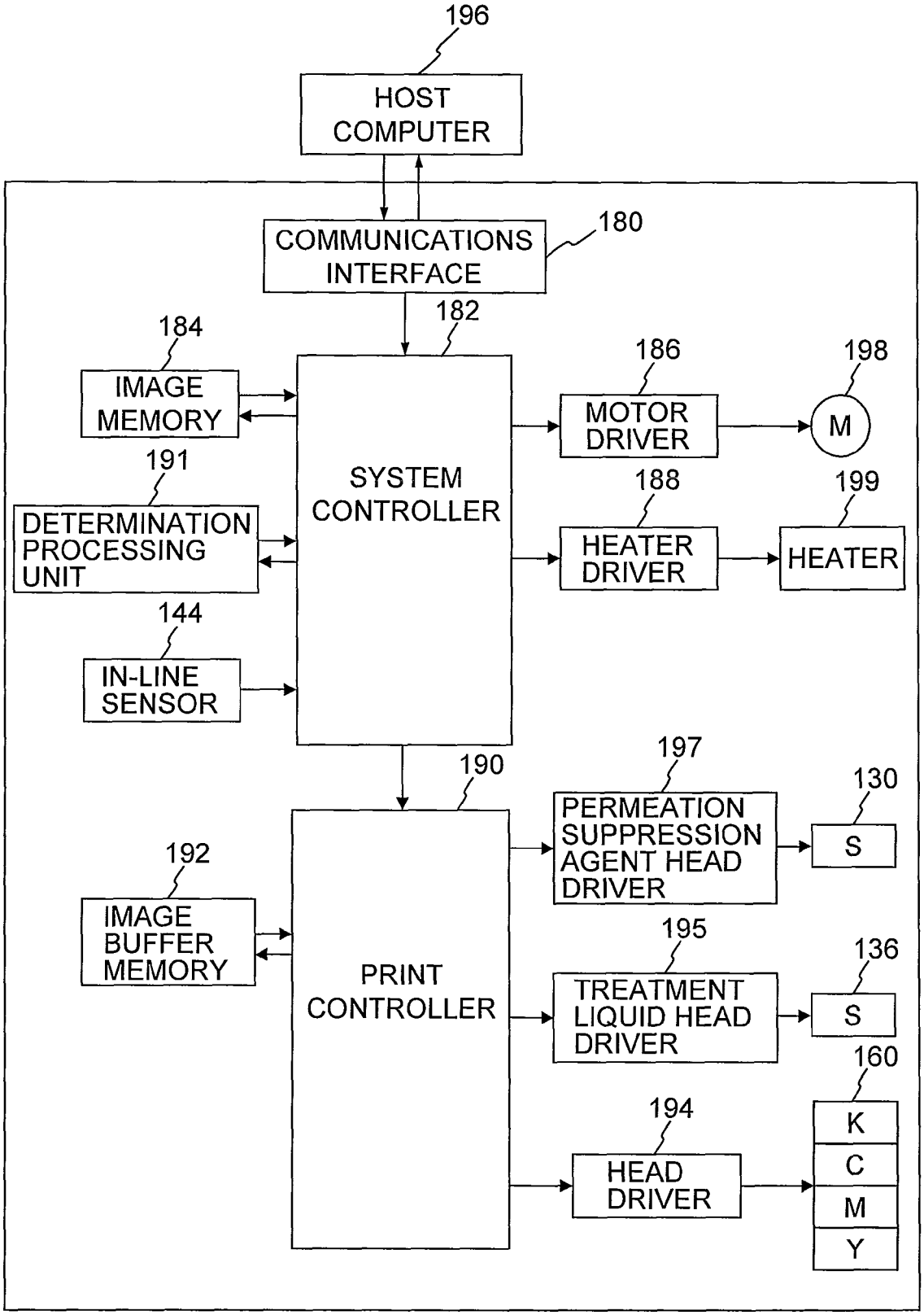
FIG. 7 is a principal block diagram illustrating a system configuration of the inkjet recording apparatus illustrated in FIG. 1.

FIG. 7 is a principal block diagram illustrating the system configuration of the inkjet recording apparatus 100. The inkjet recording apparatus 100 comprises a communications interface 180, a system controller 182, an image memory 184, a motor driver 186, a heater driver 188, a print controller 190, an image buffer memory 192, a head driver 194, and the like.

The communications interface 180 is an interface unit for receiving image data sent from a host computer 196. A serial interface such as USB (Universal Serial Bus), IEEE1394, Ethernet (registered trademark), wireless network, or a parallel interface such as a Centronics interface may be used as the communications interface 180. A buffer memory (not illustrated) may be mounted in this portion in order to increase the communication speed. The image data sent from the host computer 196 is received by the inkjet recording apparatus 100 through the communications interface 180, and is temporarily stored in the image memory 184.

The image memory 184 is a storage device for temporarily storing images inputted through the communications interface 180, and data is written and read to and from the image memory 184 through the system controller 182. The image memory 184 is not limited to a memory composed of semiconductor elements, and a hard disk drive or another magnetic medium may be used.

The system controller 182 is constituted by a central processing unit (CPU) and peripheral circuits thereof, and the like, and it functions as a control device for controlling the whole of the inkjet recording apparatus 100 in accordance with prescribed programs, as well as a calculation device for performing various calculations. More specifically, the system controller 182 controls the various sections, such as the communications interface 180, image memory 184, motor driver 186, heater driver 188, and the like, as well as controlling communications with the host computer 196 and writing and reading to and from the image memory 184, and it also generates control signals for controlling the motor 198 of the conveyance system and the heater 199.

Programs executed by the CPU of the system controller 182 and the various types of data which are required for control procedures are stored in the image memory 184. The image memory 184 may be a non-writeable storage device, or it may be a rewriteable storage device, such as an EEPROM. The image memory 184 is used as a temporary storage region for the image data, and it is also used as a program development region and a calculation work region for the CPU.

Various control programs are stored in the program storage unit (not illustrated), and a control program is read out and executed in accordance with commands from the system controller 182. The program storage unit may use a semiconductor memory, such as a ROM, EEPROM, or a magnetic disk, or the like. An external interface may be provided, and a memory card or PC card may also be used. Naturally, a plurality of these recording media may also be provided. The program storage unit may also be combined with a storage device for storing operational parameters, and the like.

The motor driver 186 is a driver which drives the motor 198 in accordance with instructions from the system controller 182. In FIG. 7, the motors (actuators) disposed in the respective sections of the apparatus are represented by the reference numeral 198. For example, the motor 198 illustrated in FIG. 7 includes motors which drive the pressure drums 126*a* to 126*d* in FIG. 1, the transfer drums 124*a* to 124*d* and the paper output drum 150.

The heater driver 188 is a driver which drives the heater 199 in accordance with instructions from the system controller 182. In FIG. 7, the plurality of heaters which are provided in the inkjet recording apparatus 100 are represented by the reference numeral 199. For example, the heater 199 illustrated in FIG. 7 includes the heaters of the paper preheating units 128 and 134 illustrated in FIG. 1, the permeation suppression agent drying unit 132, the treatment liquid drying unit 138, the solvent drying unit 142*a* and 142*b*, the heating rollers 148*a* and 148*b*, and the like.

The print controller 190 has a signal processing function for performing various tasks, compensations, and other types of processing for generating print control signals from the image data stored in the image memory 184 in accordance with commands from the system controller 182 so as to supply the generated print data (dot data) to the head driver 194. Required signal processing is carried out in the print controller 190, and the ejection amount and the ejection timing of the ink droplets from the respective print heads 160 are controlled via the head driver 194, on the basis of the print data. By this means, desired dot size and dot positions can be achieved. In FIG. 7, the plurality of heads (inkjet heads) which are provided in the inkjet recording apparatus 100 are represented by the reference numeral 160. For example, the head 160 illustrated in FIG. 7 includes the permeation suppression agent head 130, the treatment liquid head 136, the ink heads 140C, 140M, 140Y, 140K, 140R, 140G and 140B which are illustrated in FIG. 1.

The print controller 190 is provided with the image buffer memory 192; and image data, parameters, and other data are temporarily stored in the image buffer memory 192 when image data is processed in the print controller 190. Also possible is an aspect in which the print controller 190 and the system controller 182 are integrated to form a single processor.

The head driver 194 generates drive signals to be applied to the piezoelectric elements 168 of the head 160, on the basis of image data supplied from the print controller 190, and also comprises drive circuits which drive the piezoelectric elements 168 by applying the drive signals to the piezoelectric elements 168. A feedback control system for maintaining constant drive conditions in the head 160 may be included in the head driver 194 illustrated in FIG. 7.

The in-line sensor 144 is a block that includes the CCD line sensor as described above with reference to FIG. 1, reads the image printed on the recording medium 114, determines the print conditions (presence of the ejection, variation in the dot formation, and the like) by performing required signal processing, and the like, and provides the determination results of the print conditions to the determination processing unit 191 via the system controller 182.

The determination processing unit 191 judges a nozzle suffering ejection abnormality on the basis of information obtained from the in-line sensor 144, and if the ejection abnormality can be corrected by means of image correction, sends control signals to the respective sections via the system controller 182 so as to perform image correction. Furthermore, if it is not possible to remedy the abnormality by means of image correction, then control signals are sent to the respective units via the system controller 182 in such a manner that preliminary ejection or suctioning is carried out in respect of the nozzle or nozzles suffering ejection abnormality.

In other words, the determination processing unit 191 functions as a control unit for in-line inspection which is carried out in the inkjet recording apparatus 100 illustrated in the present example. A mode is also possible in which the determination processing unit 191 is formed as a functional block which is built into the system controller 182 or print controller 190.

Next, actions of the inkjet recording apparatus having the above-described structure are described.

The recording medium 114 is conveyed to the feeder board 122 from the paper supply platform 120 of the paper supply unit 102. The recording medium 114 is held on the pressure drum 126*a* of the permeation suppression processing unit 104, via the transfer drum 124*a*, and is preheated by the paper preheating unit 128, and droplets of permeation suppression agent are ejected by the permeation suppression agent head 130. Thereupon, the recording medium 114 which is held on the pressure drum 126*a* is heated by the permeation suppression agent drying unit 132, and the solvent component (liquid component) of the permeation suppression agent is evaporated and dried.

The recording medium 114 which has been subjected to permeation suppression processing in this way is transferred from the pressure drum 126*a* of the permeation suppression processing unit 104 via the transfer drum 124*b* to the pressure drum 126*b* of the treatment liquid deposition unit 106. The recording medium 114 which is held on the pressure drum 126*b* is preheated by the paper preheating unit 134 and droplets of treatment liquid are ejected by the treatment liquid head 136. Thereupon, the recording medium 114 which is held on the pressure drum 126*b* is heated by the treatment liquid drying unit 138, and the solvent component (liquid component) of the treatment liquid is evaporated and dried. By this means, a layer of aggregating treatment agent in a solid state or semi-solid state is formed on the recording medium 114.

The recording medium 114 on which a solid or semi-solid layer of aggregating treatment agent has been formed is transferred from the pressure drum 126*b* of the treatment liquid deposition unit 106 via the transfer drum 124*c* to the pressure drum 126*c* of the print unit 108. Droplets of corresponding colored inks are ejected respectively from the ink heads 140C, 140M, 140Y, 140K, 140R, 140G and 140B, onto the recording medium 114 held on the pressure drum 126*c*, in accordance with the input image data.

When ink droplets are deposited onto the aggregating treatment agent layer, then the contact surface between the ink droplets and the aggregating treatment agent layer is a prescribed surface area when the ink lands, due to a balance between the propulsion energy and the surface energy. An aggregating reaction starts immediately after the ink droplets land on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink have already aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 114.

Thereupon, the recording medium 114 held on the pressure drum 126*c* is heated by the solvent drying units 142*a* and 142*b*, and the solvent component (liquid component) which has been separated from the ink aggregate on the recording medium 114 is evaporated off and dried. As a result, curling of the recording medium 114 is prevented, and furthermore deterioration of the image quality as a result of the presence of the solvent component can be restricted.

The recording medium 114 onto which colored inks have been deposited by the print unit 108 is transferred from the pressure drum 126*c* of the print unit 108 via the transfer drum 124*d* to the pressure drum 126*d* of the fixing processing unit 110. After the printing results achieved by the print unit 108 are read out by the in-line sensor 144 from the recording medium 114 held on the pressure drum 126*d*, then heating and pressure processing are carried out by the heating rollers 148*a* and 148*b*.

When the recording medium 114 is further transferred from the pressure drum 126*d* to the paper output drum 150, it is conveyed to the paper output platform 152 by the paper output chain 154. The recording medium 114 on which an image has been formed in this way is then conveyed onto the paper output platform 152 by the paper output chain 154 and is stacked on the paper output platform 152.

Description of Determination of Ejection Abnormalities

Next, the ejection abnormality determination employed in the inkjet recording apparatus 100 illustrated in FIG. 1 will be described. In the ejection abnormality determination according to the present example, a prescribed test image is formed on a non-image portion of a recording medium 114 by the ink heads 140C, 140M, 140Y, 140K, 140R, 140G and 140B of the print unit 108, the test image is read in by an in-line sensor 144 which has an enough lower reading resolution than the recording resolution (the droplet ejection resolution of the head), and the presence or absence of ejection abnormality in the respective nozzles is judged on the basis of the reading results.

Figure 8:
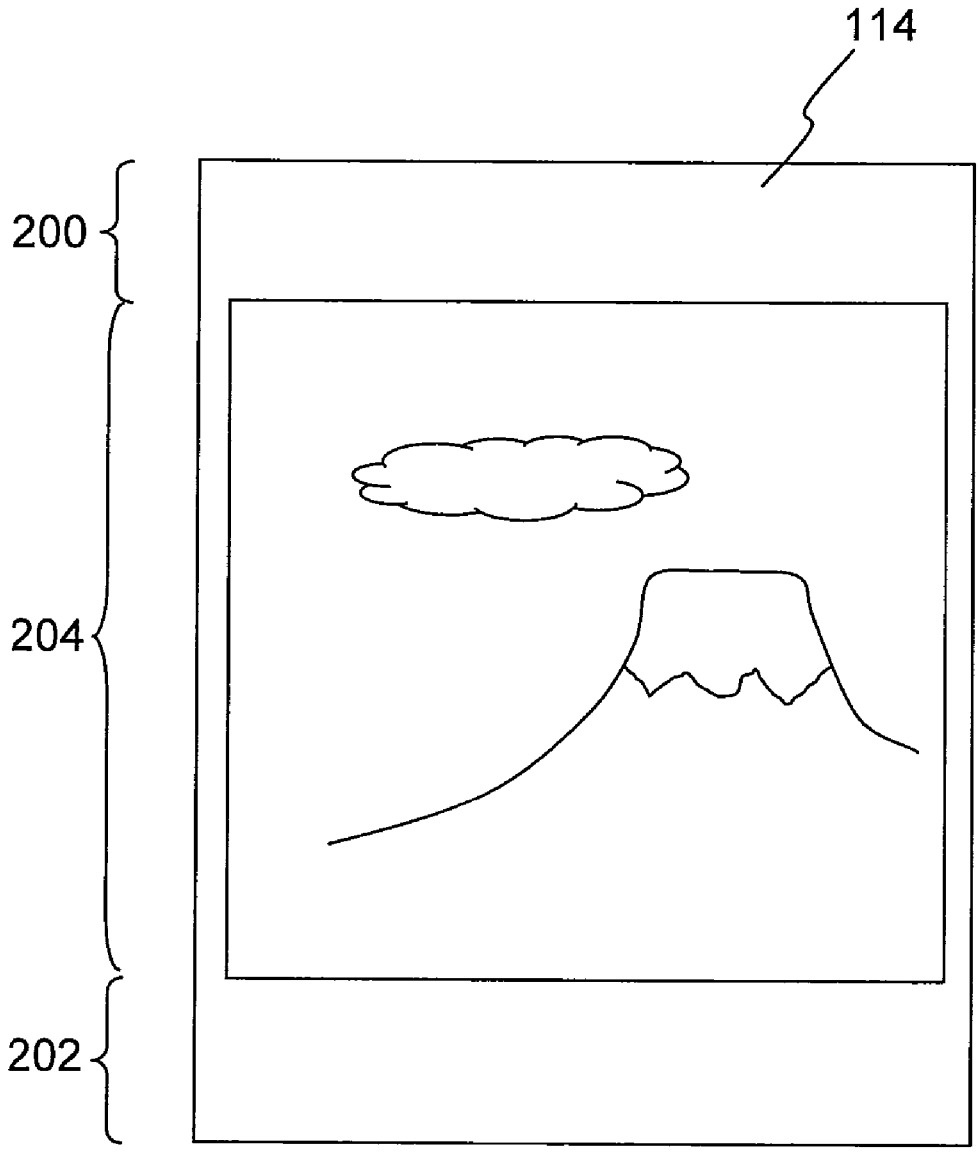
FIG. 8 is a diagram illustrating a non-image portion where a test image is formed.

FIG. 8 illustrates non-image portions 200, 202 and an image portion 204 of a recording medium 114. In the mode illustrated in FIG. 8, a non-image portion 200 is provided on the leading edge portion of the recording medium 114 (on the downstream side of the image portion 204 in terms of the conveyance direction of the recording medium) and a non-image portion 202 is provided on the trailing edge portion of the recording medium 114 (on the upstream side of the image portion 204 in terms of the conveyance direction of the recording medium). Either one of the non-image portion 200 or the non-image portion 202 can be omitted. Furthermore, if continuous paper is used, the non-image portions 200 (202) are formed before the first image portion or after the last image portion and between image portions.

If a nozzle is judged to be suffering an ejection abnormality, and this can be remedied by performing image correction by substitute droplet ejection from an adjacent nozzle, then such image correction is carried out, and if it cannot be remedied, then restoration processing is carried out in respect of the nozzle suffering the ejection abnormality.

In the description given below, the main scanning direction (the direction perpendicular to the conveyance direction of the recording medium 114) is described as the X direction and the sub-scanning direction (the conveyance direction of the recording medium 114) is described as the Y direction.

Description of Test Image

Next, a test image employed in the determination of ejection abnormalities according to the present example will be described in detail.

Figure 9:
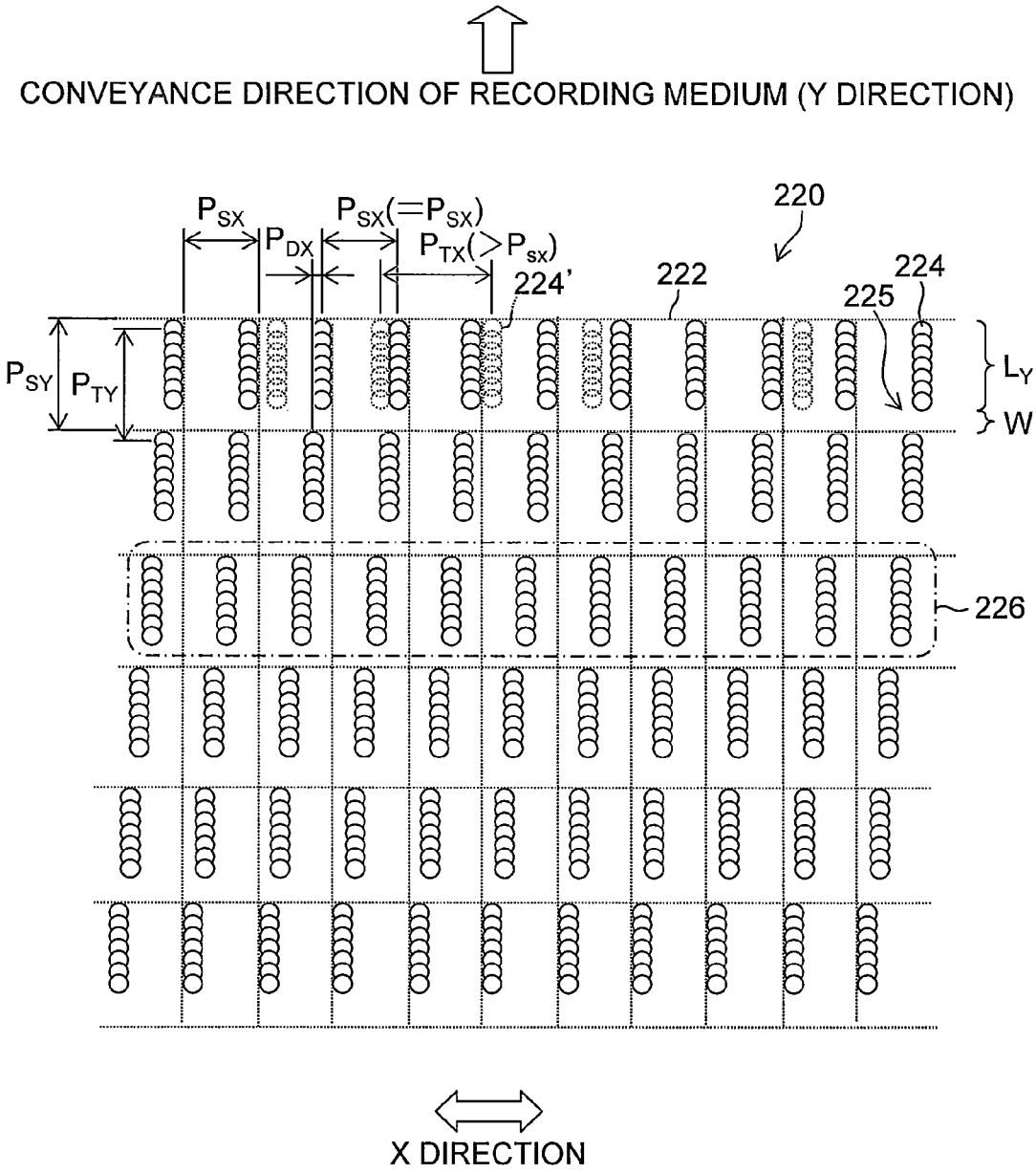
FIG. 9 is a diagram illustrating a test image according to one embodiment of the invention.

FIG. 9 illustrates a test image 220 employed in the present example. As illustrated in FIG. 9, the test image 220 is composed of vertical lines 224 formed in the Y direction in a two-dimensional configuration following a prescribed arrangement pattern, the vertical lines having a length of $L_Y$ in the Y direction and a length (width) equivalent to one dot in the X direction.

The vertical lines 224 are arranged at an arrangement pitch of n times the droplet ejection pitch in the X direction (the pitch between dots) $P_{DX}$, and n vertical line rows 226 (groups of a plurality of vertical lines 224 arranged in the X direction), are provided in the Y direction. Furthermore, the respective vertical line rows 226 are arranged in the Y direction at X-direction positions which are respectively shifted by the droplet ejection pitch $P_{DX}$ in the X direction between each row.

In other words, in forming the test image 220 illustrated in FIG. 9, ink droplets are ejected from nozzles at every $n^{th}$ position in the X direction, and in the Y direction droplets are ejected from n nozzles at positions respectively shifted by one nozzle at a time in the X direction.

In forming the test image 220 illustrated in FIG. 9, vertical lines 224 having an X-direction arrangement pitch $P_{TX}$ of $P_{DX}\times 6$ are formed by performing droplet ejection every 6 nozzles in the X direction, and droplet ejection is performed for 6 nozzles (in other words, so as to form 6 vertical line rows 226) in the Y direction, at positions respectively shifted by one nozzle at a time in the X direction.

In the test image 220 employed in the present example, taking the determination pitch (reading pitch) in the X direction of the in-line sensor 144 (see FIG. 1) to be $P_{SX}$, and taking the determination pitch in the Y direction to be $P_{SY}$, the X-direction arrangement pitch $P_{TX}$ of the vertical lines 224 satisfies $P_{TX}\geqq P_{SX}$, and the Y-direction arrangement pitch $P_{TY}$ of the vertical lines 224 (vertical line rows 226) satisfies $P_{TY}=P_{SY}\times N$ (where N is a natural number).

The vertical lines 224 indicated by the solid lines in FIG. 9 relate to a case where $P_{TX}=P_{SX}$ and $P_{TY}=P_{SY}$ (N=1), and the vertical lines 224' indicated by the broken lines (only lines in the first row are depicted) relate to a case where $P_{TX}>P_{SX}$. Of the vertical lines 224' indicated by broken lines, those which are superimposed over the vertical lines 224 indicated by the solid lines are omitted from the drawing.

Furthermore, the test image 220 comprises, in the Y direction, intervals 225 having a Y-direction length of W in such a manner that the Y-direction length $L_Y$ of the vertical lines 224 becomes shorter than the Y-direction determination pitch $P_{SY}$ of the in-line sensor 144.

The test image 220 which satisfies these conditions either has only one vertical line 224 formed by droplets ejected from one nozzle in the determination area of one determination element of the in-line sensor 144, or has no vertical line 224 at all present in one determination area. Moreover, even if there is variation in the conveyance of the recording medium 114, since an interval 225 is provided in the Y direction, then only one or less than one vertical line is present in one determination area 222. Consequently, it is possible to judge abnormalities for each vertical line 224, in other words, each nozzle, respectively and independently.

Figure 10:
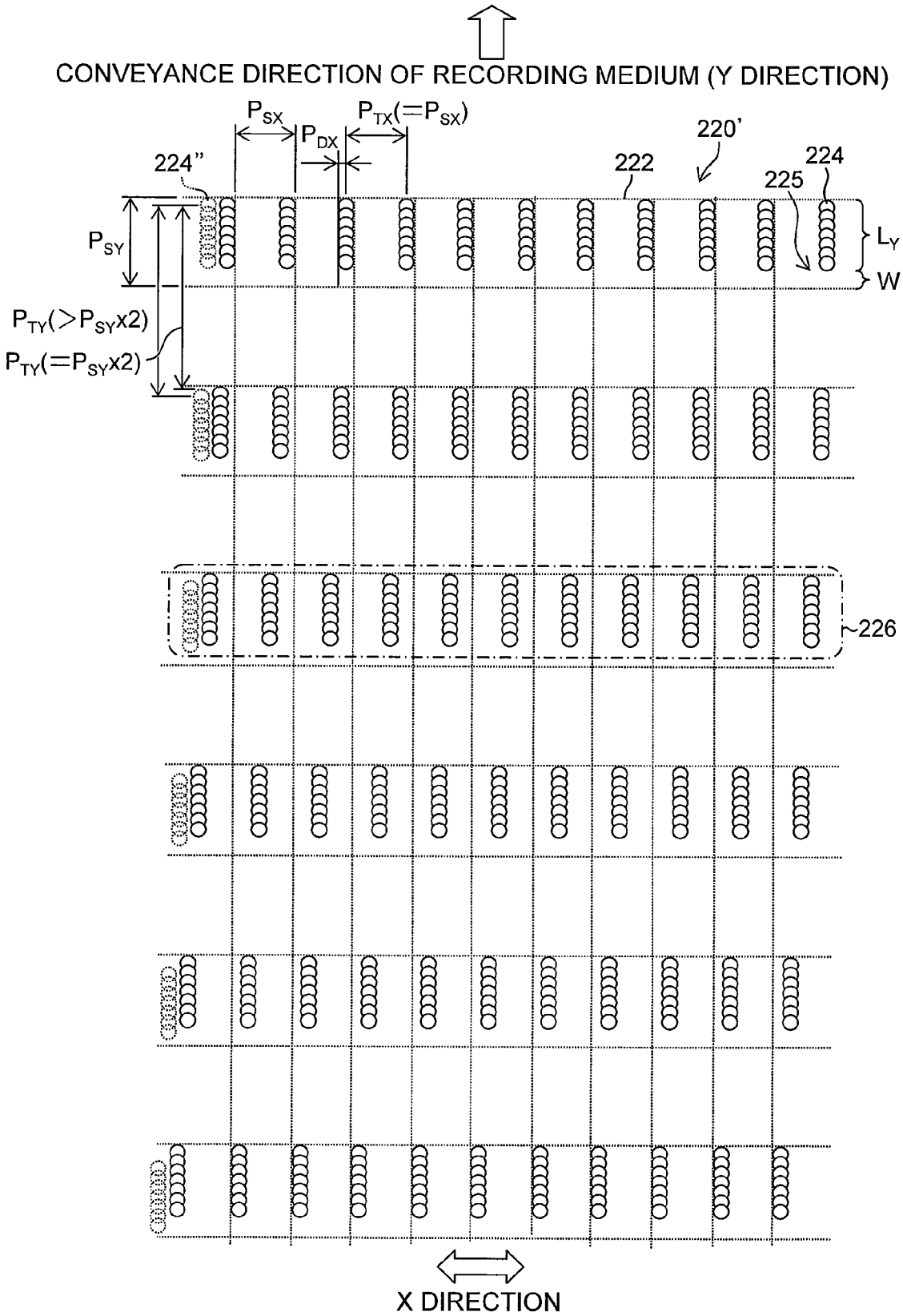
FIG. 10 is an example of a modification of the test image illustrated in FIG. 9.

Furthermore, as illustrated in FIG. 10, a desirable mode is one in which a blank line (off region 232) having a Y-direction length equal to or greater than the Y-direction determination pitch $P_{SY}$ is provided between each two vertical lines 224 (on regions 230) which are mutually adjacent in the Y direction.

In other words, in the test image 220' illustrated in FIG. 10, the Y-direction arrangement pitch $P_{TY}$ of the vertical lines 224 (vertical line rows 226) satisfies the condition $P_{TY}>P_{SY}\times N'$ (where $N'\geqq 2$). It is more desirable if N' is a natural number of 2 or above in such a manner that the periodicity of the Y-direction arrangement pitch $P_{TY}$ of the vertical lines 224 and the Y-direction determination pitch $P_{SY}$ coincide with each other, since this simplifies the analysis processing for analyzing the reading results.

In FIG. 10, a case where $P_{TY}=P_{SY}\times 2$ (N'=2) is indicated by solid lines and a case where $P_{TY}>P_{SY}\times 2$ is indicated by broken lines (one column only). The vertical lines 224" indicated by the broken lines have the same X-direction position as the vertical lines 224 indicated by the solid lines, but in the diagram, the X-direction positions of the vertical lines 224" are shifted in such a manner that they are not mutually overlapping on the diagram.

The test image 220 illustrated in FIG. 9 and FIG. 10 is formed on the recording medium 114 using the respective heads of the print unit 108 illustrated in FIG. 1 (separate test images are formed with respect for each color), the recording medium 114 on which the test images 220 has been formed passes directly below the in-line sensor 144 at a uniform conveyance speed, one vertical line row 226 is read in each read operation, and by performing a read operation the same number of times as the number of vertical line rows 226, it is possible to read in all of the vertical lines 224 formed by using all of the nozzles of the respective heads.

In order to read one vertical line 224 accurately by means of one inspection element, it is necessary for the reading position of the in-line sensor 144 to correspond to the start of the test image 220 (220'), and it is necessary for the test image 220 and the position of the inspection pixels of the in-line sensor 144 to coincide in the X-direction.

In other words, the phase alignment processing of the in-line sensor 144 and the test images 220 (220') is carried out in the X direction and the Y direction. The results of the phase alignment processing are stored in the prescribed memory.

Figure 11:
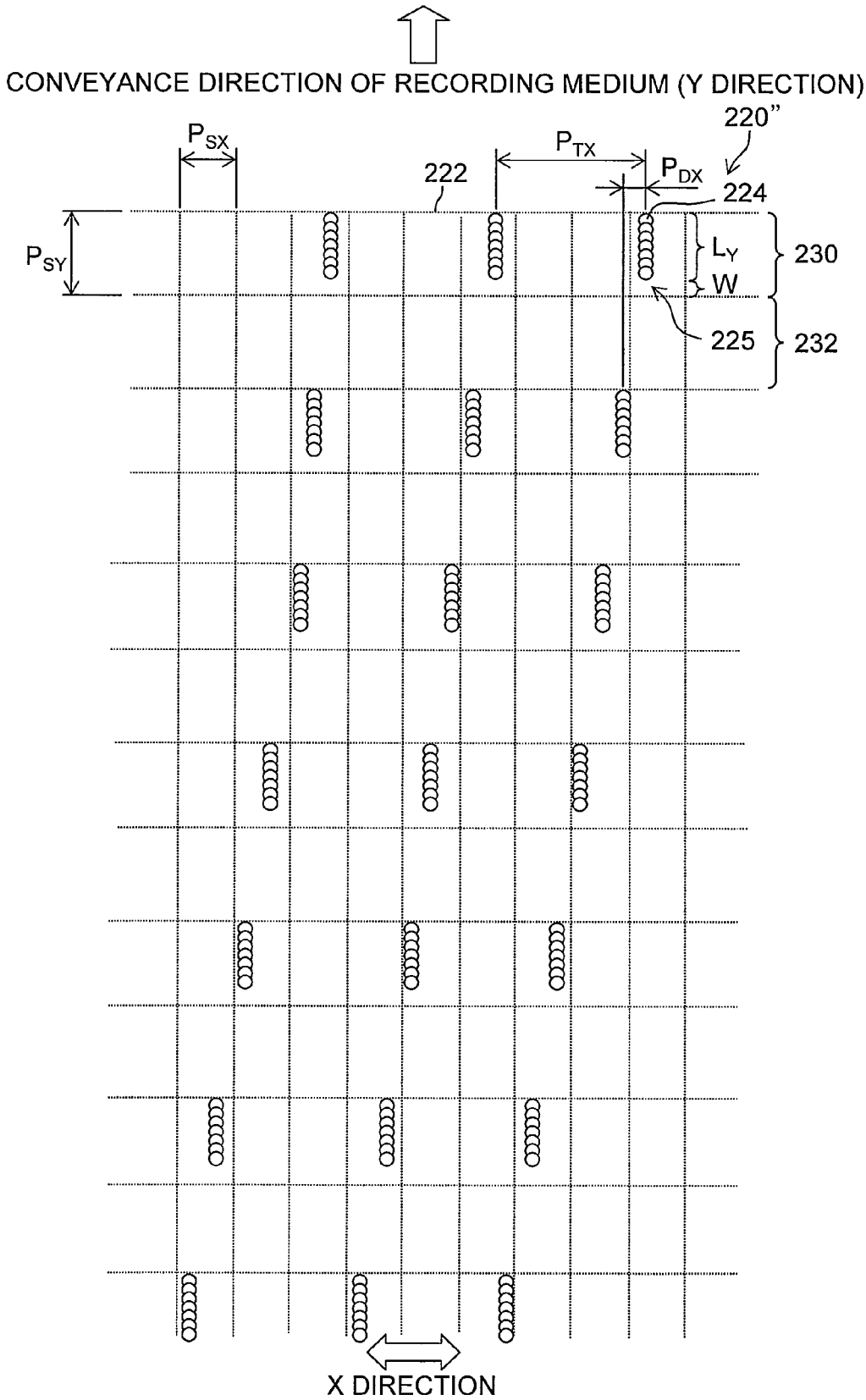
FIG. 11 is an example of a further modification of the test image illustrated in FIG. 9.

FIG. 11 illustrates a further mode (test image 220") of the test image 220 (220') illustrated in FIG. 9 and FIG. 10. In FIG. 11, parts which are the same as or similar to those in FIG. 9 and FIG. 10 are labeled with the same reference numerals and further explanation thereof is omitted here.

The conditions of the head resolution (image resolution) of the test image 220" illustrated in FIG. 11 and the reading resolution of the in-line sensor 144 are as indicated below.

Resolution of head in main scanning direction (X direction): $N_x$=1200 (dpi)

Resolution of head in sub scanning direction (Y direction): $N_Y$=1200 (dpi)

Resolution of in-line sensor 144 in main scanning direction (X direction): $S_x$=500 (dpi)

Resolution of in-line sensor 144 in sub scanning direction (Y direction): $S_Y$=127 (dpi)

In other words, the droplet ejection pitch (pitch between dots) $P_{DX}$ in the X direction satisfies $P_{DX}$=0.021 (mm), the droplet ejection pitch $P_{DY}$ in the Y direction satisfies $P_{DY}$=0.021 (mm), the determination pitch $P_{SX}$ of the in-line sensor 144 in the X direction satisfies $P_{SX}$=0.05 (mm) and the determination pitch $P_{SY}$ of the in-line sensor 144 in the Y direction satisfies $P_{SY}$=0.2 (mm). Furthermore, the width of the vertical lines 224 in the X direction is equivalent to 1 dot=30 (μm).

In a head (matrix head) having nozzles arranged in a matrix configuration as illustrated in FIG. 3B, the X-direction droplet ejection pitch $P_{DX}$ corresponds to the nozzle pitch P in the main scanning direction. Furthermore, the X-direction determination pitch $P_{SX}$ is determined by the magnification ratio of the lens constituting the in-line sensor 144, the X-direction width of the inspection pixels and the arrangement pitch of the inspection pixels, and the Y-direction determination pitch $P_{SY}$ is determined by the period of signal transfer in the in-line sensor, the Y-direction length of the inspection pixels, and the conveyance speed of the recording medium.

Description of X-Direction Arrangement Pitch $P_{TX}$

The X-direction arrangement pitch $P_{TX}$ of the vertical lines 224 in the test image 220 is set to a sufficient interval in the X direction, in such a manner that mutually adjacent droplet ejections (vertical lines 224) are not read in within the X-direction determination pitch $P_{SX}$ (=0.05 (mm)).

In other words, the X-direction arrangement pitch $P_{TX}$ of the vertical lines 224 is determined by taking account of the ratio between the X-direction determination pitch $P_{DX}$ and the X-direction droplet ejection pitch $P_{SX}$ ($P_{SX}/P_{DX}$), and allowing a margin for variation in the droplet ejection size and a margin for variation in the droplet ejection direction, in such a manner that vertical lines 224 formed by droplets ejected from two or more nozzles do not come within the X-direction determination pitch $P_{SX}$.

Consequently, the X-direction arrangement pitch $P_{TX}$ of the vertical lines 224 is determined from $P_{TX}=P_{DX}\times N$ (natural number), and in the present example, $P_{SX}/P_{DX}$=2.4, and so allowing a margin for variation in the droplet ejection size and a margin for variation in the droplet ejection direction, N is set to N=7. Furthermore, the number of vertical line rows 226 is set to seven rows.

Concrete Example of Phase Alignment Processing

Next, a concrete example of processing for aligning the phase of the in-line sensor 144 (see FIG. 1) and the test image will be described.

In the test images 220, 220' and 220" illustrated in FIG. 9 to FIG. 11, the arrangement and periodicity of the vertical line rows 226 are determined in accordance with the determination frequency of the in-line sensor 144. However, if there is a discrepancy between the timing at which the leading edge (printing position) of the test image 220 reaches the in-line sensor 144 read start position, and the read start timing of the in-line sensor 144, then it may not be possible to perform accurate reading. Furthermore, in the X direction also, if there is deviation between the X-direction phase (position) of the inspection pixels and the vertical line rows 226, then it may not be possible to perform accurate reading.

Consequently, it is necessary to carry to phase alignment processing for aligning the read start position of the in-line sensor 144 and the start position of the test image 220 in the X direction and Y direction.

FIRST EXAMPLE

Firstly, it is confirmed that the same vertical line column 228 is not being read in by two inspection elements in the X direction. This can be done by checking for the presence of displacement in the X direction by progressively reading in the vertical lines 224 while forming the vertical line rows 226 at respectively shifted positions in the X direction.

Figure 12:
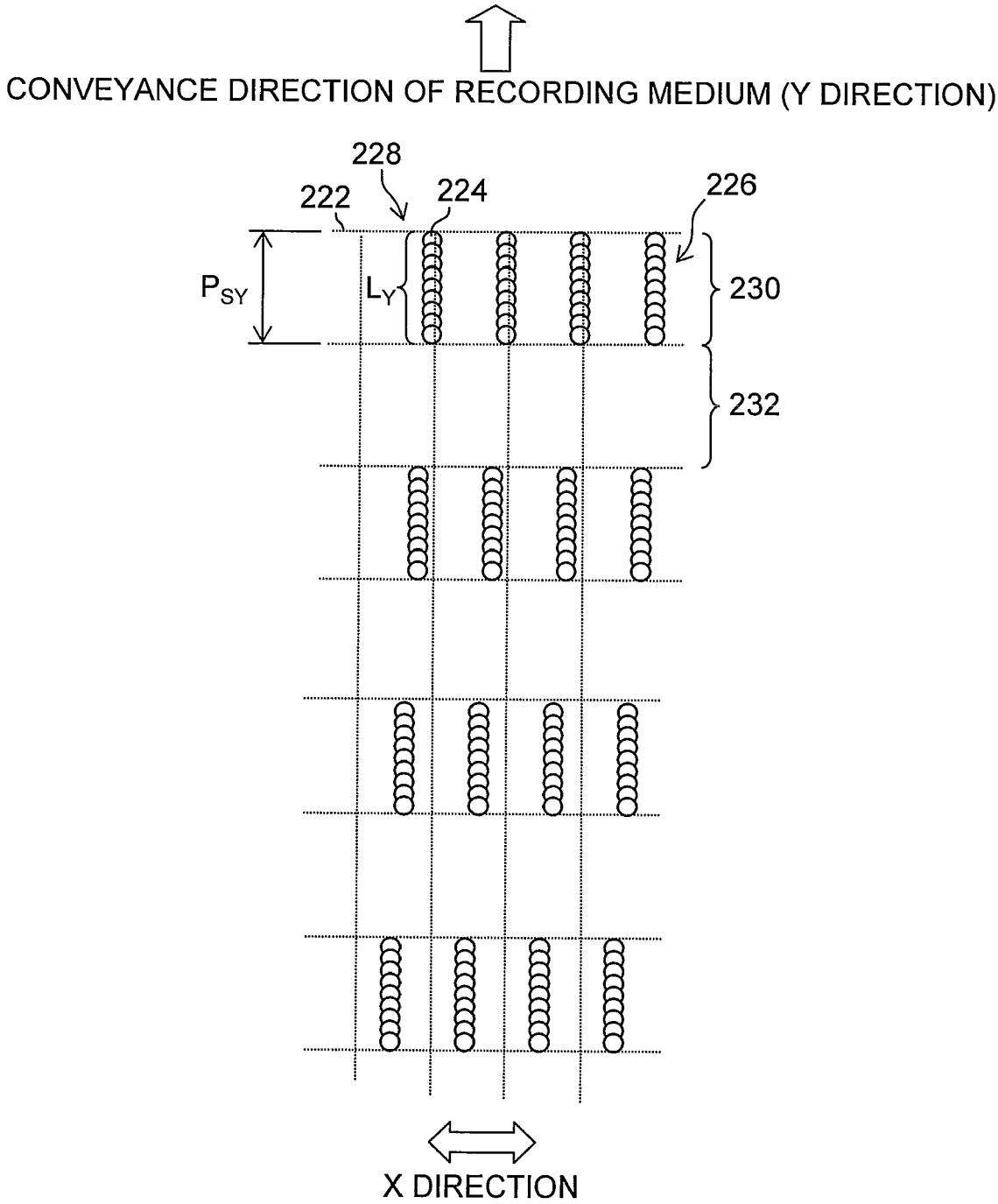
FIG. 12 is a diagram illustrating phase alignment of the test image illustrated in FIG. 9 to FIG. 11.

Next, as illustrated in FIG. 12, the Y-direction length $L_y$ of the vertical lines 224 is set to be equal to the inspection pitch in the Y direction $P_{SY}$, and at least one vertical line row 226 (on region 230) and off regions 232 of the same number as the vertical line rows 226 are formed. FIG. 12 illustrates a mode where four on regions and four off regions are formed.

These are read in by the in-line sensor 144 (see FIG. 1), and the determination light intensity of the on regions 230 with respect to the determination light intensity of the off regions 232 (the determination light intensity ratio) is found. In other words, the determination light intensity ratio is the ratio between the maximum value and the minimum value of the output signal of the respective inspection pixels.

Next, the Y-direction position is shifted and on regions 230 and off regions 232 are formed in a similar fashion, read in by the in-line sensor 144, and the determination light intensity ratio is found. By repeating this processing, the state where the determination light intensity ratio reaches a largest value is stored as the "state (position) where the Y-direction phase is aligned".

SECOND EXAMPLE

It is also possible to carry out the alignment described above by means of the method described below.

Droplets are ejected to create an all on pattern 240 at every other vertical column of the inspection pixels of the in-line sensor 144, this pattern 240 is determined by the in-line sensor 144, and the droplet ejection start point in the X direction is moved, one ejection dot at a time, in such a manner that the determination light intensity ratio between the on columns and off columns becomes a maximum value.

Figure 13:
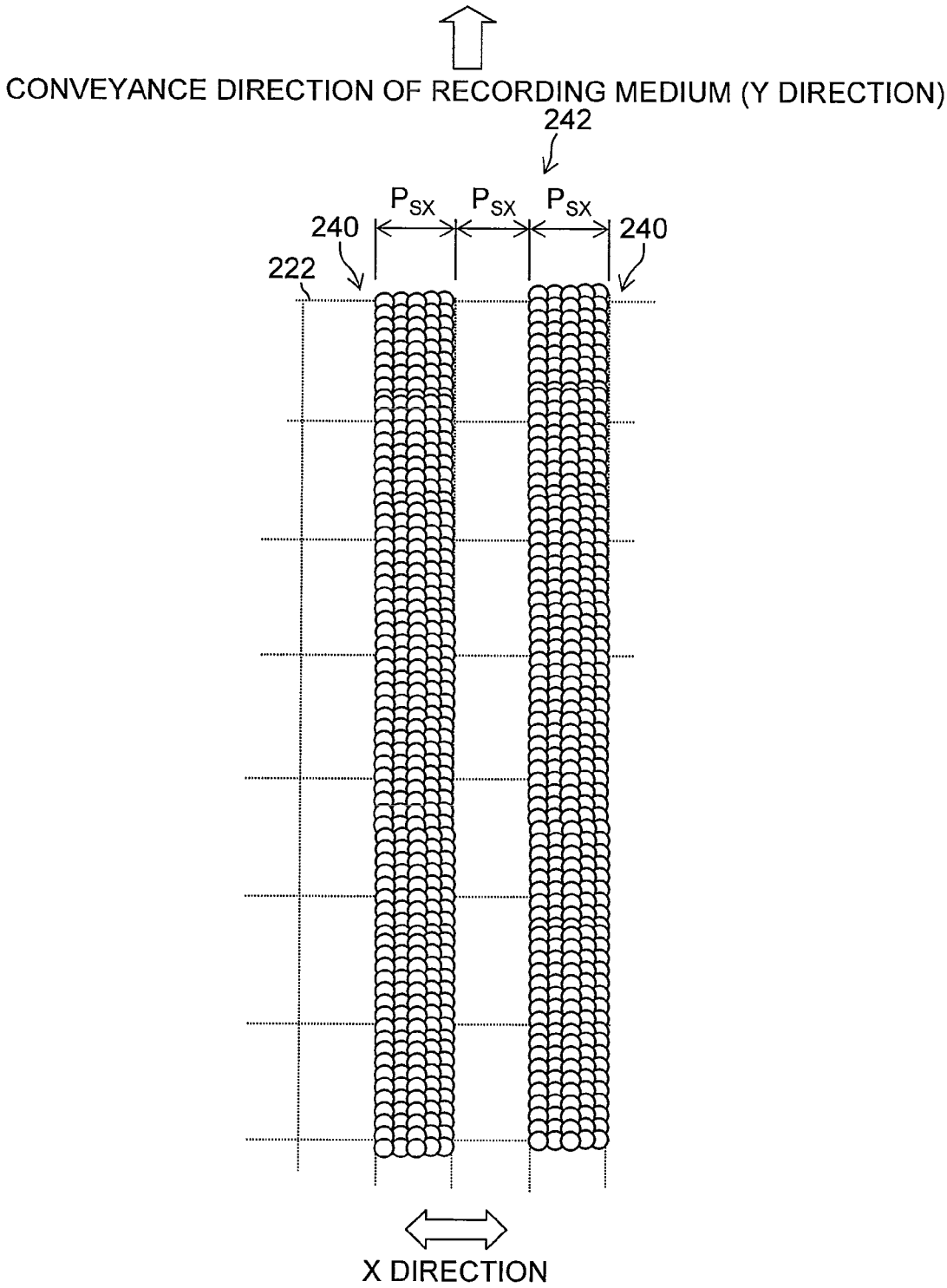
FIG. 13 is a diagram illustrating a further mode of the phase alignment illustrated in FIG. 12 (X-direction phase alignment)

In other words, as illustrated in FIG. 13, an X-direction phase alignment test pattern 242 is formed by arranging, in two or more rows in the X direction, all on patterns 240 formed following the Y direction and each having an X-direction length of the same magnitude as the X-direction determination pitch $P_{SX}$, an interval equal to the X-direction determination pitch $P_{SX}$ being left between the respective patterns 240.

The test pattern 242 is read in by the in-line sensor 144 and the ratio of the magnitudes of the determination signals obtained from the read pixels which are mutually adjacent in the X direction (the determination light intensity ratio between the on column and off column) is determined. Next, a test pattern 242 is formed at a position displaced by the droplet ejection pitch $P_{DX}$ in the X direction, the test pattern 242 is read out by the in-line sensor 144, and the determination light intensity ratio is determined. This processing is repeated, and the state where the largest value is obtained for the ratio (the determination light intensity ratio between the on column and off column) between the magnitudes of the determination signals obtained from read pixels that are mutually adjacent in the X direction (the on pixels (pixels that are on if there is no phase misalignment) and the off pixels (pixels that are off if there is no phase misalignment)) is stored as the "state (position) where the X-direction phase is aligned".

Next, the phase alignment in the Y direction is carried out. In Y-direction phase alignment, the X direction and Y direction in the phase alignment for the X direction should be interchanged.

Figure 14:
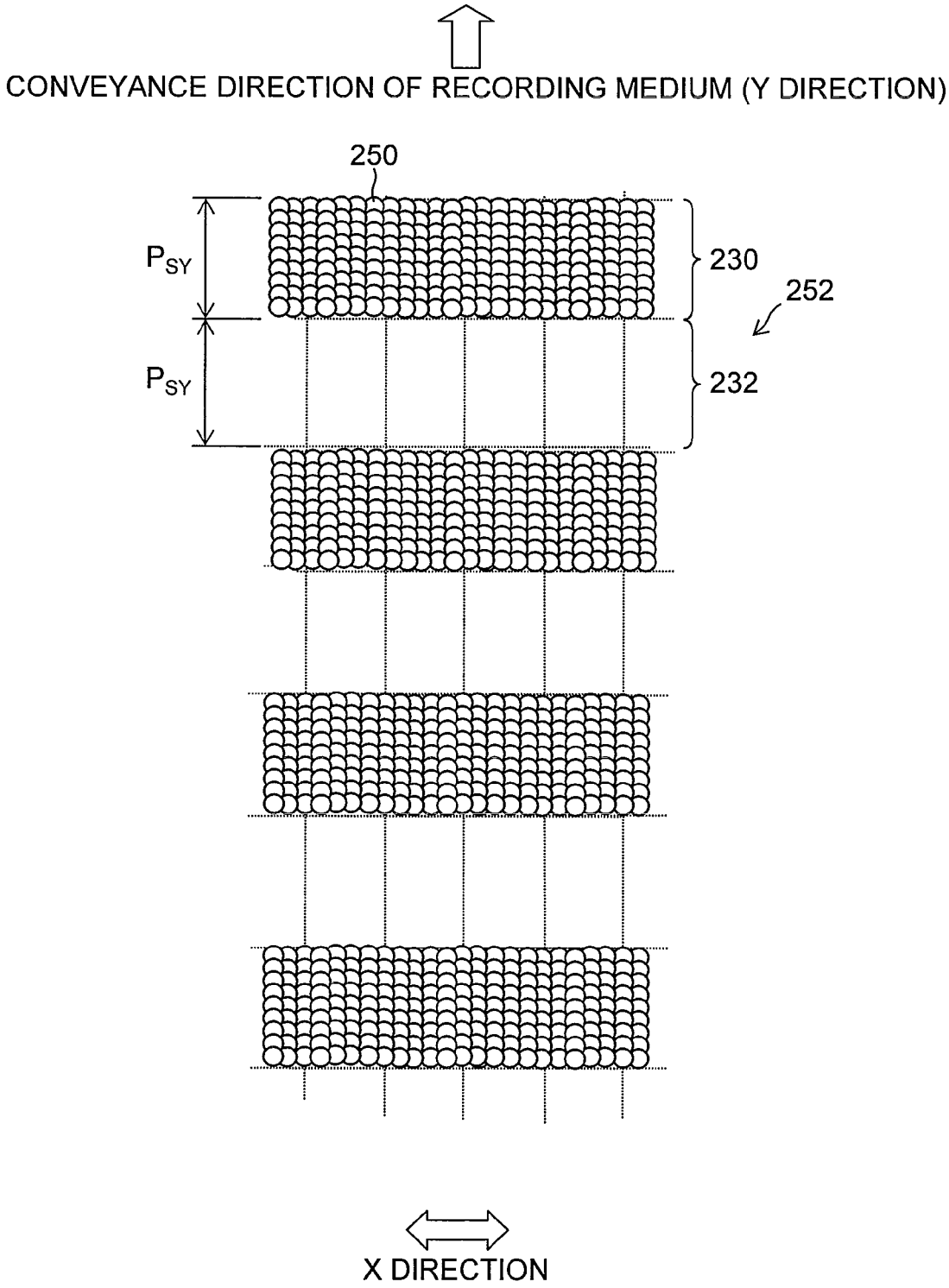
FIG. 14 is a diagram illustrating Y-direction phase alignment illustrated in FIG. 13.

As illustrated in FIG. 14, in Y-direction phase alignment, an all on pattern (horizontal lines 250) is formed by ejecting droplets at every other horizontal row of inspection pixels of the in-line sensor 144, and this pattern is determined by the in-line sensor 144 and the droplet ejection start point in the Y direction is moved one ejection dot at a time in such a manner that a maximum value is obtained for the determination light intensity ratio between the on row and off row.

In other words, a Y-direction phase alignment test pattern 252 is formed by arranging in the Y direction two or more horizontal lines 250 having a Y-direction length of the same magnitude as the Y-direction size of one inspection image and having an X-direction length greater than the X-direction determination pitch $P_{SX}$ in the X direction, an interval of equal magnitude to the Y-direction inspection pitch $P_{YS}$ being left between the horizontal lines 250.

The test pattern 252 is read in by the in-line sensor 144 and the ratio between the magnitudes of the determination signals obtained from the respective inspection pixels (the determination light intensity ratio between the on row and the off row) is found. Thereupon, a test pattern 252 is formed at a position displaced in the Y direction by the Y-direction droplet ejection pitch $P_{DY}$ (not illustrated), the test pattern 252 is read in by the in-line sensor 144, and the ratio between the maximum value and the minimum value of the determination signals obtained from the respective inspection pixels (the determination light intensity ratio) is found. This processing is repeated and the state where the determination light intensity ratio obtained from the respective inspection pixels assumes a largest value is stored as the "state (position) where the Y-direction phase is aligned".

In this way, the phase is aligned in the X direction and the Y direction. The phase alignment processing described above is always carried out when the apparatus is first started up, and the state where the phase is aligned in the X direction and Y direction is stored in a prescribed storage area inside the apparatus as an initial parameter for that apparatus.

Furthermore, during the operation of the apparatus, positional displacement of the in-line sensor 144 and the test image 220 may occur, depending on the operating conditions, the temperature, the humidity and the type of recording medium used, and the like, and therefore a composition which carries out phase alignment as and when appropriate should be adopted.

The state in which the phase alignment processing has been carried out is stored separately for each color by applying prescribed processing such as sharpness processing and outline enhancement to the read image of the determined test pattern, and binarizing on the basis of a previously established threshold value.

Optimization of Y-direction Length $L_y$ of Vertical Lines

Next, the processing of optimizing the Y-direction length of the vertical lines 224 will be described.

When the X-direction and Y-direction phase alignments have been carried out, the Y-direction length $L_y$ of the vertical lines 224 is optimized. If the length $L_y$ in the Y direction is too short, then depending on the sensitivity of the in-line sensor 144 (inspection pixels), it may be impossible to obtain a determination signal. On the other hand, if the length $L_y$ in the Y direction is too long, then two vertical lines 224 may span two inspection pixels. Therefore, it is necessary to optimize the Y-direction length $L_y$ (the Y-direction length W of the interval 225 in FIG. 9).

Furthermore, since there is a concern that the determination results may be affected if there is variation in the conveyance of the recording medium 114, then it is desirable that the Y-direction length $L_y$ of the vertical lines 224 should be shorter than the Y-direction size of the determination pixels, in such a manner that a vertical line 224 does not span two determination pixels, even if there should be variation in the conveyance in the Y direction.

Figure 15A:
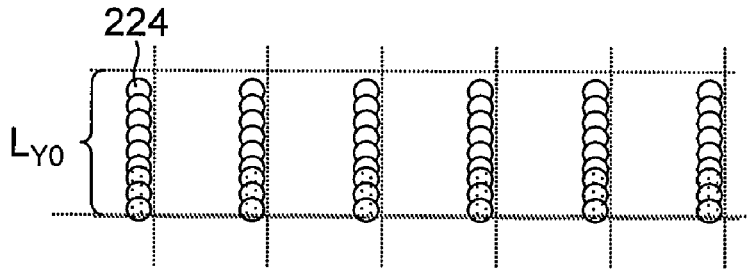
FIGS. 15A to 15D are diagrams illustrating an interval.

Firstly, the Y-direction length $L_{YO}$ of the vertical lines 224 is determined, as illustrated in FIG. 15A. In the example illustrated in FIG. 15A, the length $L_{YO}$ is taken as the determination pitch $P_{SY}$ in the Y direction.

Figure 15B:
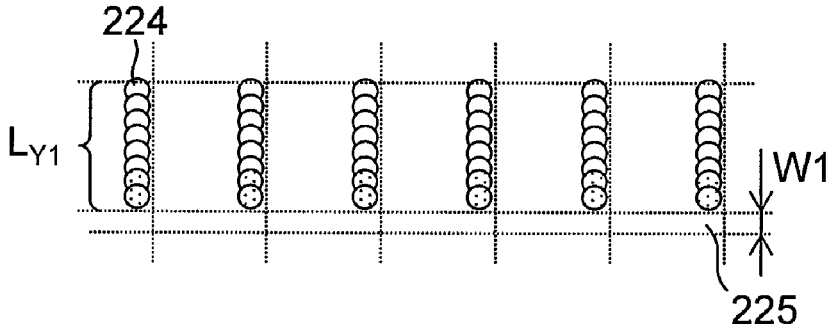
Figure 15C:
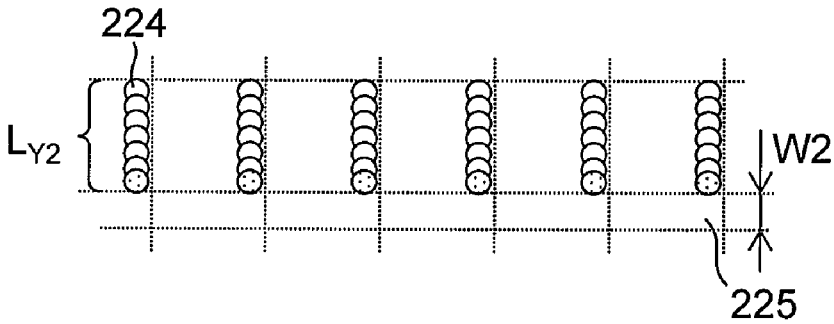
Figure 15D:
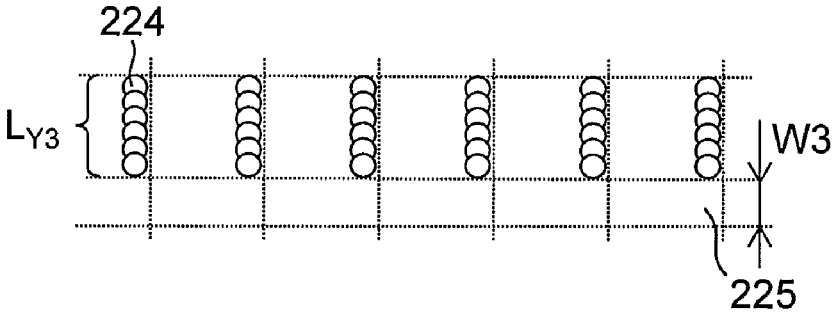

Next, as illustrated in FIGS. 15B to 15D, the Y-direction length is gradually shortened as follows, $L_{Y1}=L_Y-W_1$, $L_{Y2}=L_Y-W_2$, $L_{Y3}=L_Y-W_3$, (the Y-direction length W ($W_1$, $W_2$, $W_3$) of the interval 225 is gradually increased, and an interval 225 whereby determination is possible even if there is positional variation due to the conveyance of the recording medium 114 is set and stored.

The length is varied while checking for phase misalignment by inserting blank rows (the off regions 232 in FIG. 10) every other row, but if there is little change in the Y direction (if there is little phase misalignment in the Y direction), then blank rows do not have to be inserted.

The variation in the Y direction (variation in conveyance) changes with the thickness and type of recording medium 114, and the temperature and humidity of the environment where the apparatus is situated. Therefore, it is effective to find a reference for the interval in the pattern by passing recording media 114 of various types through the apparatus when the apparatus is set up, ejecting droplets to form straight lines in the breadthways direction of the recording medium 114 and measuring the positions of the lines from the ends of the paper.

Figure 16:
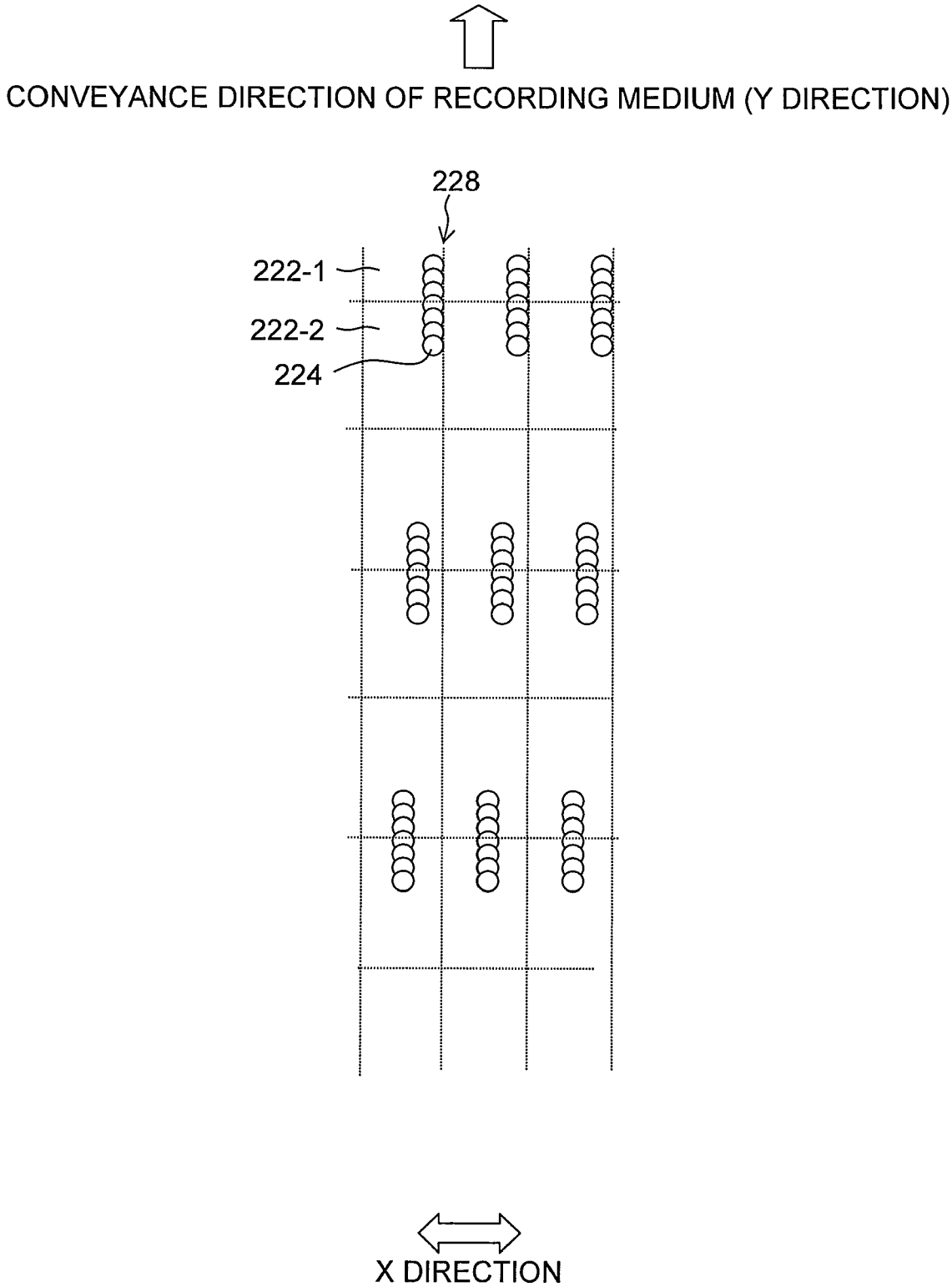
FIG. 16 is a diagram illustrating an undesirable example of a test image.
Figure 17:
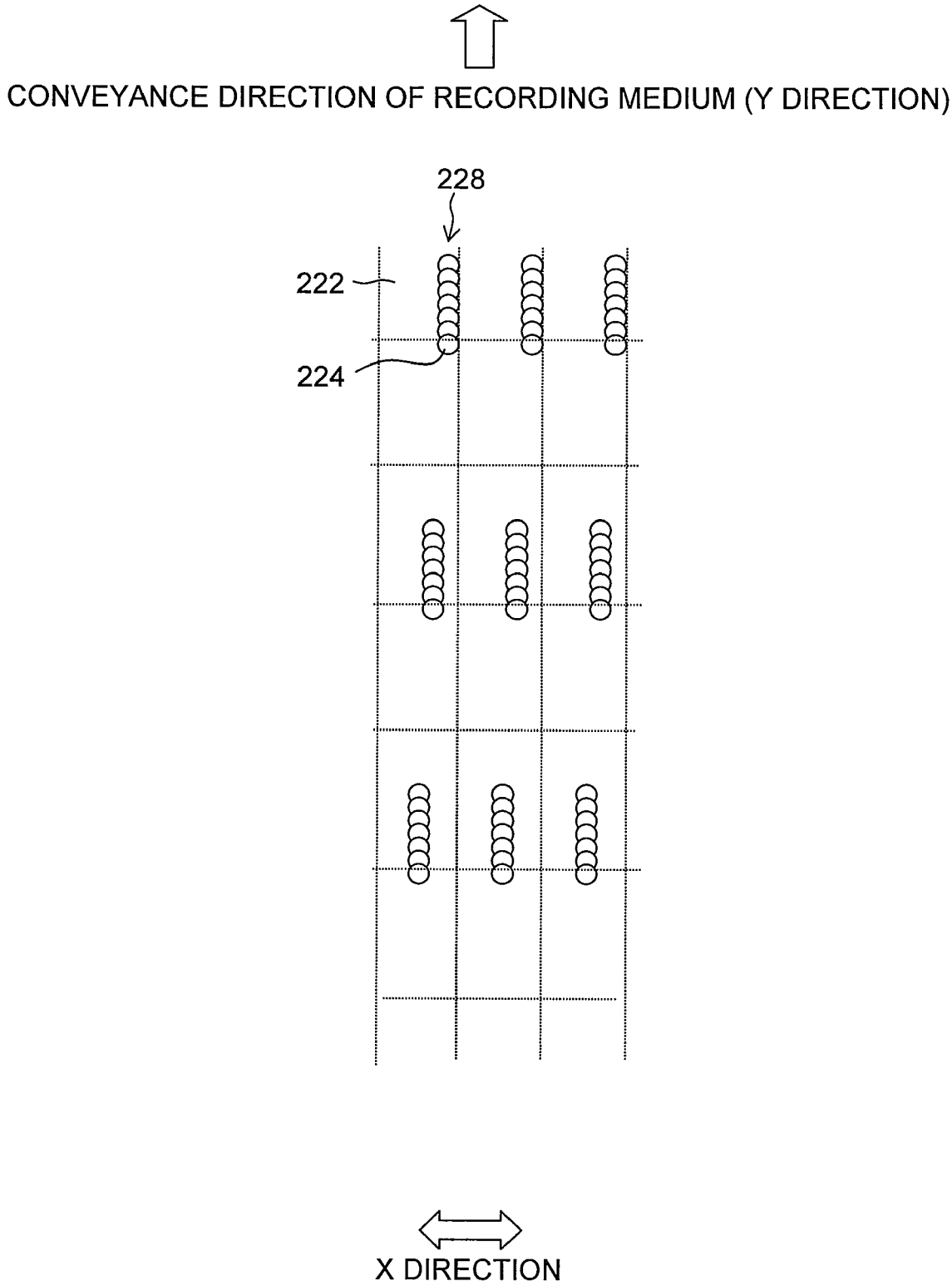
FIG. 17 is a diagram illustrating a further undesirable example of a test image.
Figure 18:
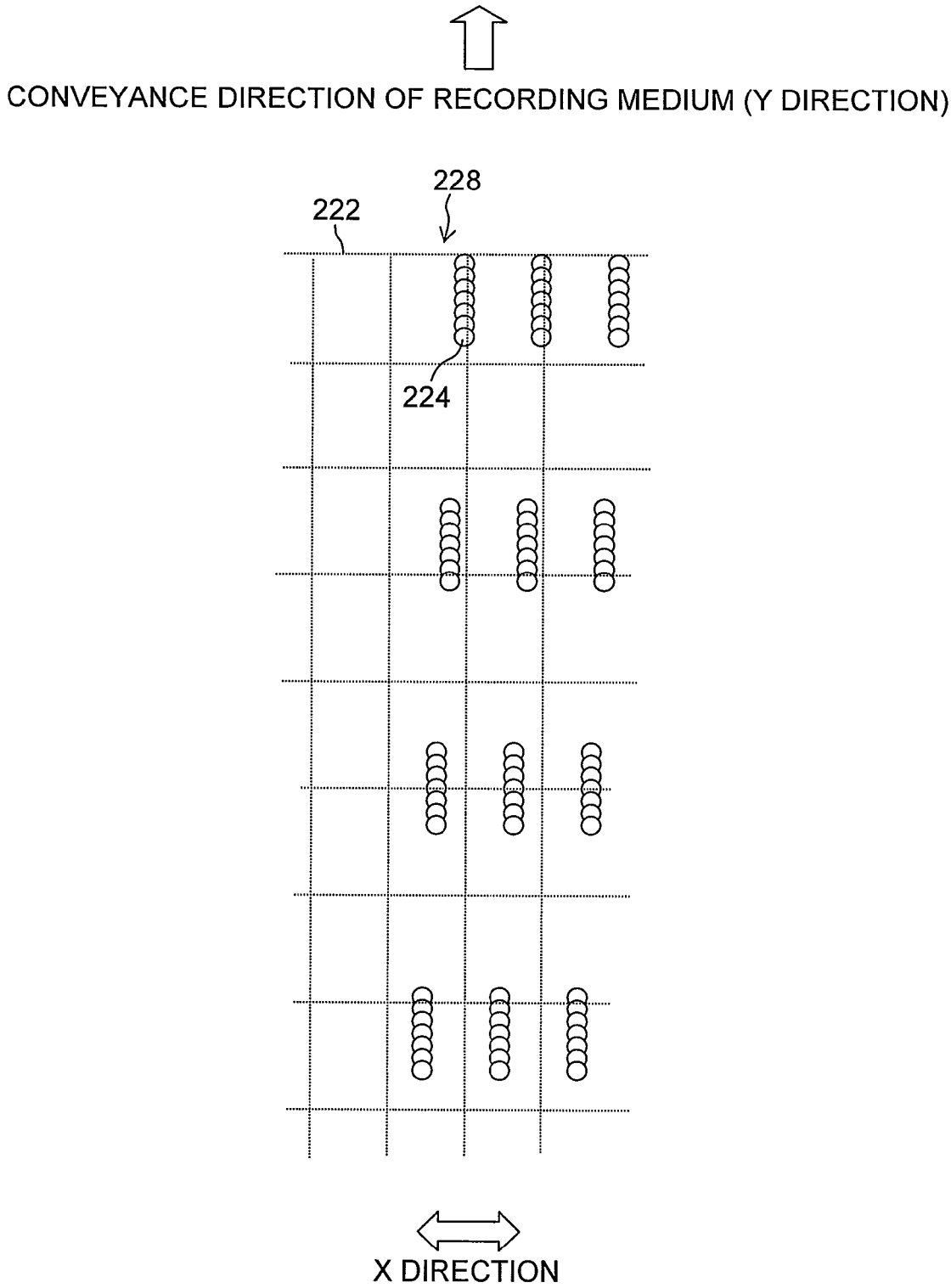
FIG. 18 is a diagram illustrating yet a further undesirable example of a test image.

FIGS. 16 and 17 illustrate states where vertical lines 224 span two inspection pixels (the determination regions 222-1, 222-2 of two inspection pixels), due to phase misalignment in the Y direction, and FIG. 18 illustrates a case where the intensity of the determination signal changes periodically due to divergence between the Y-direction periodicity of the test image 220 and the Y-direction periodicity of the in-line sensor 144.

Figure 19:
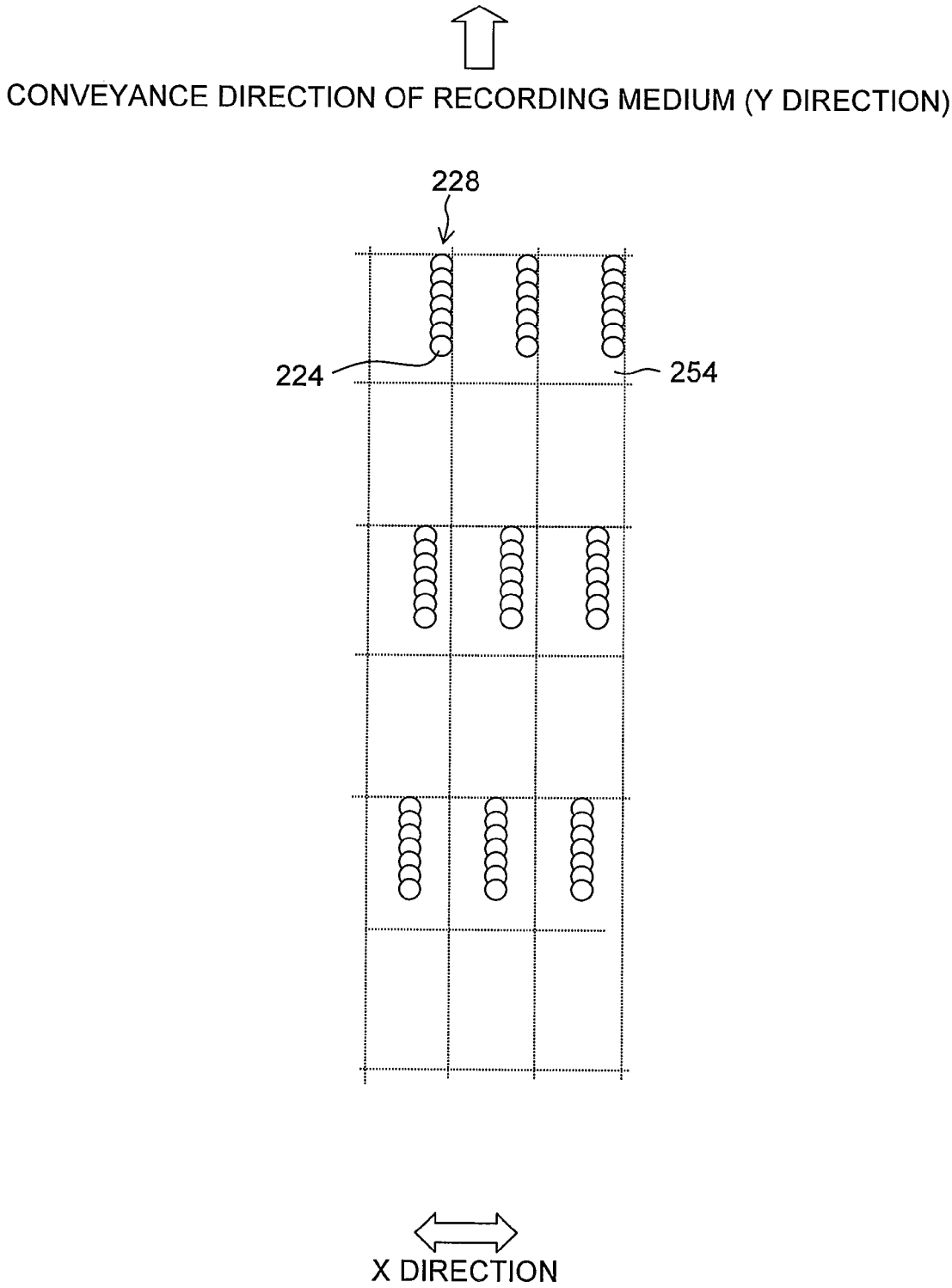
FIG. 19 is a diagram illustrating a desirable example of a test image.

On the other hand, FIG. 19 illustrates a test image 220 (220') in which an optimal interval 225 has been set (an optimal Y-direction length $L_Y$ has been set) by carrying out X-direction and Y-direction phase alignment. In the present example, by forming a test image 220 such as that illustrated in FIG. 19, it is possible to determine ejection abnormalities in each individual nozzle, by using an in-line sensor 144 having a reading resolution which is lower than the recording resolution.

In the present example, a mode is described in which ejection abnormalities are determined with respect to each head (for each color), but by using a color sensor corresponding to RGB, it is also possible to determine ejection abnormalities in respect of a plurality of heads (a plurality of colors), within a single process.

Figure 20:
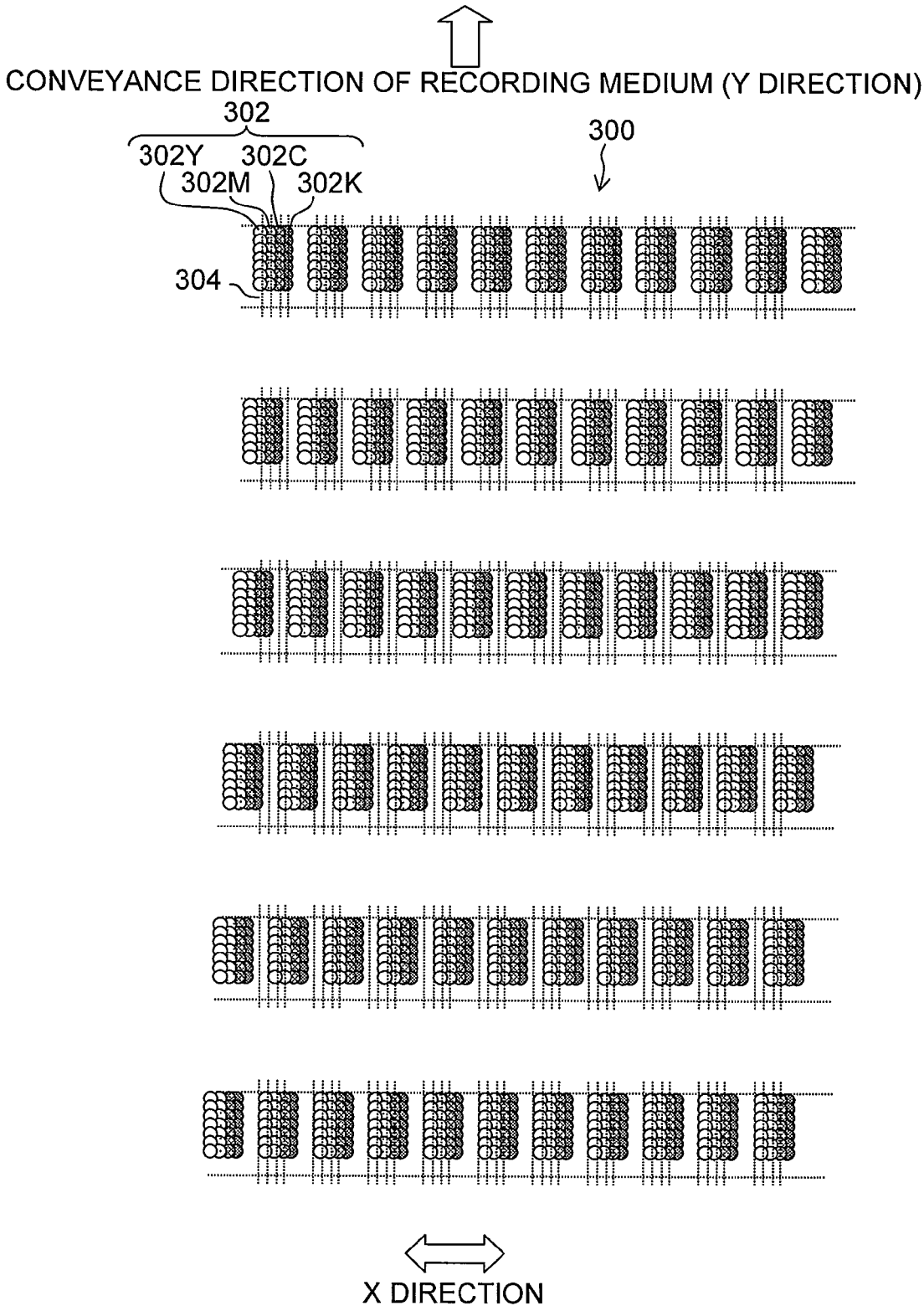
FIG. 20 is an example of a further modification of the test image illustrated in FIG. 9 to FIG. 11.

FIG. 20 illustrates a test image 300 for determining ejection abnormalities in the same process for four heads (four colors, such as Y, M, C, K). The test image 300 illustrated in FIG. 20 comprises Y vertical lines 302Y corresponding to yellow, M vertical lines 302M corresponding to magenta, C vertical lines 302C corresponding to cyan, and K vertical lines 302K corresponding to black, and the Y vertical lines 302Y, M vertical lines 302M, C vertical lines 302C and K vertical lines 302K form one vertical line group 302.

When forming the test image 300 illustrated in FIG. 20, the process of aligning phase in the X direction and Y direction and setting the Y-direction lengths (optimizing the interval 304) of the respective Y vertical lines 302Y, M vertical lines 302M, C vertical lines 302C and K vertical lines 302K are carried out with respect to each color.

In other words, even in the case of the Y vertical lines 302Y, M vertical lines 302M, C vertical lines 302C and K vertical lines 302K which are included in the same vertical line group, cases may arise where the Y-direction length of the lines and the Y-direction length of the interval 304 are different.

FIG. 20 illustrates a mode where Y vertical lines 302Y, M vertical lines 302M, C vertical lines 302C and K vertical lines 302K are formed by ejecting droplets at respectively shifted positions in the X direction, but it is also possible to eject droplets in such a manner that the Y vertical lines 302Y, the M vertical lines 302M, the C vertical lines 302C and the K vertical lines 302K are overlapping.

Description of In-line Inspection

Next, in-line inspection (ejection abnormality determination) using the test images described above will be explained.

In the in-line inspection according to the present example, all of the output images (test images formed in the white margins of an actual image, see FIG. 9, FIG. 10 and FIG. 18) are read in by the in-line sensor 144, and if no vertical line 224 is present in a region where there should be a vertical line 224 (vertical line group 302), then it is judged that the nozzle corresponding to that vertical line 224 is suffering ejection abnormality. An output image which contains an ejection abnormality is marked as a defective image, by for instance attaching a sticker with a tape inserter device, or the like, or affixing a stamp indicating an abnormality, or the like.

Moreover, the ejection data (image data) corresponding to the output head is immediately corrected in such a manner that a defective image is not output for the same reason. A possible example of this correction of image data is to perform substitute droplet ejection from a nozzle which is adjacent to the ejection abnormality nozzle (namely, enlarging the dots, or forming a dot at a position where the originally intended dot is not formed).

On the other hand, if it is judged that the defect is of a level which cannot be corrected by correcting the ejection data, then the apparatus transfers to a head maintenance mode (head restoration processing mode) where head restoration processing such as flushing, wiping or suctioning of the head is carried out.

When restoration processing has been carried out on a nozzle suffering an ejection failure, it is then confirmed that the nozzle suffering ejection failure has been restored, whereupon the apparatus transfers to normal image recording mode.

As described above, in the test image, since the X-direction and Y-direction pattern arrangement interval of the test image, and the Y-direction length of the pattern are determined on the basis of the droplet ejection pitch of the head and the inspection pixel pitch of the in-line sensor, and furthermore since the Y-direction length of the pattern is determined while changing the Y-direction length of the pattern, then as well as satisfying the sensor sensitivity conditions, it is also possible to employ a Y-direction pattern length which suffers little effect in terms of variation in the position of the test image due to the conveyance of the recording medium.

Furthermore, the test image relating to the present mode makes it possible to reduce the surface area occupied on the recording medium, and hence the images which can be formed on the recording medium can be made as large as possible.

Moreover, by adopting ejection abnormality determination using a test image as illustrated in the present embodiment, then it is possible to judge the presence or absence of ejection abnormalities with respect to each nozzle, using an in-line sensor having a reading resolution which is lower than the recording resolution of the image, and hence improved reliability is expected in the determination of ejection abnormalities and mistaken detection of abnormalities can be reduced.

A desirable mode is one in which the test image forming method described above is stored in a prescribed storage medium as a control program (test image forming program). This program can be stored in an internal storage device of the apparatus or it can be stored in an external device which is attached to the apparatus, such as a hard disk device. Furthermore, it is also possible to store the program on a storage medium such as a CD-ROM or memory card which can be separated from an apparatus.

In one embodiment of the present invention, a test image is formed before or after the recorded image and in-line inspection is carried out for determining ejection abnormalities before or after forming the image, but it is also possible to apply the present invention to cases where only a test image is formed on the recording medium, as a mode of determining ejection abnormalities.

In the present embodiment, a drum conveyance method is described as a recording medium conveyance device, but it is also possible to use another method, such as a belt conveyance method, to convey the recording medium.

Furthermore, in the present example, before carrying out image recording on the recording medium, a permeation treatment layer is formed on the recording medium and moreover a treatment liquid which aggregates or insolubilizes the coloring material in the ink by reacting with the ink is also deposited, but it is also possible to omit the deposition of the permeation suppressing agent or the deposition of treatment liquid, as and where appropriate.

The present embodiment is one mode of the present invention, and it is of course possible to implement modifications or amendments, as appropriate, without deviating from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

a head having a plurality of nozzles which eject an ink onto a recording medium;

a conveyance device which conveys the recording medium;

a droplet ejection control device which controls ink ejection of the head;

a test image forming device that forms a test image on the recording medium by causing the ink to be ejected from every n (where n is a natural number equal to 2 or higher)

nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed; and a reading device which is provided on a conveyance path of the recording medium, reads in a test image on the recording medium and has an image reading structure covering a length corresponding to full width of the recording medium in a breadthways direction which is perpendicular to the direction in which the recording medium is conveyed, wherein in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

2. The inkjet recording apparatus as defined in claim 1, wherein the arrangement pitch in the X direction of the vertical lines is m times the reading pitch in the X direction of the reading device (where m is an integer equal to 2 or higher).

3. The inkjet recording apparatus as defined in claim 1, wherein the droplet ejection control device controls the ink ejection of the head in such a manner that a formation start position for the test image on the recording medium coincides with a reading start position of the reading device on the recording medium.

4. The inkjet recording apparatus as defined in claim 1, wherein:

the test image forming device forms the test image in such a manner that the vertical lines have alteration in the length in the Y direction;

the reading device reads in the vertical lines having the alteration in the length in the Y direction;

the inkjet recording apparatus comprises a calculation device which determines an optimal length for the vertical lines for which intensity of a read signal obtained from the reading device indicates a maximum value; and the droplet ejection control device controls the ink ejection of the head in such a manner that the length in the Y direction of the vertical lines is the optimal length determined by the calculation device.

5. The inkjet recording apparatus as defined in claim 1, wherein the test image is formed on a non-image portion of the recording medium provided to at least one of an upstream side or a downstream side in the Y direction of an image region of the recording medium where an actual image is formed.

6. The inkjet recording apparatus as defined in claim 1, wherein:

the heads are provided respectively for a plurality of colors; and the test image is formed in such a manner that vertical lines of different colors are formed in one determination region.

7. The inkjet recording apparatus as defined in claim 1, wherein:

the heads are provided respectively for a plurality of colors; and the test image is formed separately for each of the heads.

8. The inkjet recording apparatus as defined in claim 1, comprising an abnormality judgment device which judges presence or absence of an abnormal nozzle in the head, according to results of reading in the test image by the reading device.

9. The inkjet recording apparatus as defined in claim 8, comprising an image correction device which corrects image data in cases where the abnormality judgment device judges that the abnormal nozzle is present in the head, wherein the droplet ejection control device controls the ink ejection of the head according to the image data corrected by the image correction device.

10. The inkjet recording apparatus as defined in claim 8, comprising a restoration processing device which, in cases where the abnormality judgment device judges that the abnormal nozzle is present in the head, carries out restoration processing on a nozzle which the abnormality judgment device judges as the abnormal nozzle.

11. An inkjet recording apparatus comprising:

a head having a plurality of nozzles which eject an ink onto a recording medium;

a conveyance device which conveys the recording medium;

a droplet ejection control device which controls ink ejection of the head;

a test image forming device that forms a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed; and a reading device which is provided on a conveyance path of the recording medium, reads in a test image on the recording medium and has an image reading structure covering a length corresponding to full width of the recording medium in a breadthways direction which is perpendicular to the direction in which the recording medium is conveyed, wherein in the test image, an arrangement pitch in the X direction of the vertical lines is equal to or exceeding a reading pitch in the X direction of the reading device, an arrangement pitch in the Y direction of the vertical lines is twice or more than twice a reading pitch in the Y direction of the reading device, and an interval corresponding to variation in a conveyance of the recording medium is provided between the vertical lines in such a manner that a length in the Y direction of each of the vertical lines is less than the reading pitch in the Y direction of the reading device.

12. The inkjet recording apparatus as defined in claim 11, wherein the arrangement pitch in the Y direction of the vertical lines is n times the reading pitch in the Y direction of the reading device (where n is a natural number equal to 2 or higher).

13. The inkjet recording apparatus as defined in claim 11, wherein the arrangement pitch in the X direction of the vertical lines is m times the reading pitch in the X direction of the reading device (where m is an integer equal to 2 or higher).

14. The inkjet recording apparatus as defined in claim 11, wherein the droplet ejection control device controls the ink ejection of the head in such a manner that a formation start position for the test image on the recording medium coincides with a reading start position of the reading device on the recording medium.

15. The inkjet recording apparatus as defined in claim 11, wherein:

the test image forming device forms the test image in such a manner that the vertical lines have alteration in the length in the Y direction;

the reading device reads in the vertical lines having the alteration in the length in the Y direction;

the inkjet recording apparatus comprises a calculation device which determines an optimal length for the vertical lines for which intensity of a read signal obtained from the reading device indicates a maximum value; and the droplet ejection control device controls the ink ejection of the head in such a manner that the length in the Y direction of the vertical lines is the optimal length determined by the calculation device.

16. The inkjet recording apparatus as defined in claim 11, wherein the test image is formed on a non-image portion of the recording medium provided to at least one of an upstream side or a downstream side in the Y direction of an image region of the recording medium where an actual image is formed.

17. The inkjet recording apparatus as defined in claim 11, wherein:

the heads are provided respectively for a plurality of colors; and the test image is formed in such a manner that vertical lines of different colors are formed in one determination region.

18. The inkjet recording apparatus as defined in claim 11, wherein:

the heads are provided respectively for a plurality of colors; and the test image is formed separately for each of the heads.

19. The inkjet recording apparatus as defined in claim 11, comprising an abnormality judgment device which judges presence or absence of an abnormal nozzle in the head, according to results of reading in the test image by the reading device.

20. The inkjet recording apparatus as defined in claim 19, comprising an image correction device which corrects image data in cases where the abnormality judgment device judges that the abnormal nozzle is present in the head, wherein the droplet ejection control device controls the ink ejection of the head according to the image data corrected by the image correction device.

21. The inkjet recording apparatus as defined in claim 19, comprising a restoration processing device which, in cases where the abnormality judgment device judges that the abnormal nozzle is present in the head, carries out restoration processing on a nozzle which the abnormality judgment device judges as the abnormal nozzle.

22. A test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of:

controlling ink ejection of the head so as to form a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed, in such a manner that, in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

23. A test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of:

controlling ink ejection of the head so as to form a test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which shift by one nozzle in the X direction and each extend continuously in terms of a Y direction parallel to the direction in which the recording medium is conveyed, in such a manner that, in the test image, an arrangement pitch in the X direction of the vertical lines is equal to or exceeding a reading pitch in the X direction of the reading device, an arrangement pitch in the Y direction of the vertical lines is twice or more than twice a reading pitch in the Y direction of the reading device, and an interval corresponding to variation in a conveyance of the recording medium is provided between the vertical lines in such a manner that a length in the Y direction of each of the vertical lines is less than the reading pitch in the Y direction of the reading device.

24. A non-transitory computer-readable medium storing instructions to cause a computer to execute at least a test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of:

controlling ink ejection of the head so as to form the test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which each extend continuously in terms of a Y direction parallel to the direction in which the recording medium is conveyed and shift by one nozzle in the X direction, in such a manner that, in the test image, an arrangement pitch in the X direction of the vertical lines is equal to or exceeding a reading pitch in the X direction of the reading device, an arrangement pitch in the Y direction of the vertical lines is N times a reading pitch in the Y direction of the reading device (where N is a natural number), and an interval corresponding to variation in a conveyance of the recording medium is provided between the vertical lines in such a manner that a length in the Y direction of each of the vertical lines is less than the reading pitch in the Y direction of the reading device.

25. A non-transitory computer-readable medium storing instructions to cause a computer to execute at least a test image forming method for an inkjet recording apparatus which ejects an ink onto a recording medium from a plurality of nozzles provided in a head while conveying the recording medium, and which comprises a reading device which reads in an image formed on the recording medium, the test image forming method comprising the step of:

controlling ink ejection of the head so as to form the test image on the recording medium by causing the ink to be ejected from every n (where n is a natural number equal to 2 or higher) nozzles in an X direction perpendicular to a direction in which the recording medium is conveyed, and causing the ink to be ejected so as to form vertical lines forming n columns which each extend continuously in terms of a Y direction parallel to the direction in which the recording medium is conveyed and shift by one nozzle in the X direction, in such a manner that, in the test image, an arrangement pitch in the X direction of the vertical lines is equal to or exceeding a reading pitch in the X direction of the reading device, an arrangement pitch in the Y direction of the vertical lines is twice or more than twice a reading pitch in the Y direction of the reading device, and an interval corresponding to variation in a conveyance of the recording medium is provided between the vertical lines in such a manner that a length in the Y direction of each of the vertical lines is less than the reading pitch in the Y direction of the reading device.

* * * * *